US010765176B2

(12) United States Patent
Castiglione et al.

(10) Patent No.: US 10,765,176 B2
(45) Date of Patent: Sep. 8, 2020

(54) PERSONAL PROTECTIVE DEVICE STRAP CONNECTING BUCKLE ASSEMBLY

(71) Applicant: 3M INNOVATIVE PROPERTIES COMPANY, St. Paul, MN (US)

(72) Inventors: David M. Castiglione, Hudson, WI (US); David M. Blomberg, Lino Lakes, MN (US); David R. Stein, White Bear Lake, MN (US); Michael J. Cowell, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 826 days.

(21) Appl. No.: 15/309,264

(22) PCT Filed: May 12, 2015

(86) PCT No.: PCT/US2015/030240
§ 371 (c)(1),
(2) Date: Nov. 7, 2016

(87) PCT Pub. No.: WO2015/179163
PCT Pub. Date: Nov. 26, 2015

(65) Prior Publication Data

US 2017/0065036 A1 Mar. 9, 2017

Related U.S. Application Data

(60) Provisional application No. 62/001,859, filed on May 22, 2014.

(51) Int. Cl.
*A41D 13/11* (2006.01)
*A44B 11/26* (2006.01)
(Continued)

(52) U.S. Cl.
CPC ..... *A44B 11/263* (2013.01); *A41D 13/1161* (2013.01); *A44B 11/008* (2013.01); *A62B 18/084* (2013.01)

(58) Field of Classification Search
CPC ..... A44B 11/263; A44B 11/00; A44B 11/006; A44B 11/2592; A44B 11/2584;
(Continued)

(56) References Cited

U.S. PATENT DOCUMENTS 2,979,794 A 4/1961 Bartolo
3,163,905 A * 1/1965 Gaylord ..... A44B 11/10 24/196

(Continued)

FOREIGN PATENT DOCUMENTS

| | | |
|---|---|---|
| JP | 08-103305 | 4/1996 |
| TW | 2579206 | 10/2003 |
| WO | WO 2009-038315 | 3/2009 |

OTHER PUBLICATIONS

International Search report for PCT International Application No. PCT/US2015/030240 dated Aug. 5, 2015, 3 pages.

*Primary Examiner* — Ophelia A Hawthorne

(57) ABSTRACT

A buckle assembly for selectively connecting first and second straps of a personal protective device. The buckle assembly includes a receiver member and a latch member configured for coupling to a respective one of the straps. The receiver member defines a slot and provides a release arm. The latch member includes a latch tab pivotally connected to a base. In a latched state in which the latch member is disposed within the slot and a latch face is engaged with a capture surface. The release arm disposed over a portion of the latch tab. The latch face can be disengaged from the capture surface in response to an actuation force applied to the release arm. In some embodiments, the receiver member and the latch member incorporate various, complimentary
(Continued)

guide surfaces that promote easy insertion of the latch member into the receiver member.

18 Claims, 15 Drawing Sheets

(51) Int. Cl.
*A62B 18/08* (2006.01)
*A44B 11/00* (2006.01)

(58) Field of Classification Search
CPC ... A44B 11/2503; A44B 11/08; A44B 11/266; A41D 13/1161; A41D 13/00; A41D 13/05; A41D 213/055; A41D 13/0556; A41D 13/0568; A41D 13/11; A41D 13/1169; A41D 2300/32; A41D 2300/322; A41D 2300/324; A41D 2300/326; A41D 2300/328; A41D 2300/332; A62B 18/084; A62B 18/00; A62B 18/02; A62B 18/08; Y10T 24/45524; Y10T 24/45529; A44D 2203/00; A44D 2205/00; A44D 2201/00; F16B 2/12; F16B 2/16; F16B 2/18; F16B 2/20; F16B 2/185; F16B 3/00
USPC ..... 128/863
See application file for complete search history.

(56) References Cited

U.S. PATENT DOCUMENTS

| | | | | | |
|---|---|---|---|---|---|
| 3,255,502 | A | | 6/1966 | Hollins | |
| 3,900,923 | A | | 8/1975 | Thomas | |
| 4,727,630 | A | | 3/1988 | Alan | |
| 5,464,010 | A | * | 11/1995 | Byram | A62B 18/084 128/207.11 |
| 5,551,131 | A | * | 9/1996 | Anscher | A44B 11/263 24/606 |
| 6,776,161 | B2 | | 8/2004 | Horn | |
| 7,650,884 | B2 | | 1/2010 | Flannigan | |
| 8,695,601 | B2 | | 4/2014 | Hitchcock | |
| 2004/0221432 | A1 | | 11/2004 | Nezu | |
| 2005/0055810 | A1 | | 3/2005 | Loughlin | |
| 2008/0230069 | A1 | | 9/2008 | Valcic | |
| 2009/0000624 | A1 | | 1/2009 | Lee | |
| 2009/0007395 | A1 | | 1/2009 | Ida | |
| 2009/0193628 | A1 | | 8/2009 | Gebrewold | |
| 2011/0220115 | A1 | | 9/2011 | Castiglione | |
| 2012/0030912 | A1 | | 2/2012 | Turdjian | |
| 2012/0260920 | A1 | | 10/2012 | Choi | |
| 2012/0325221 | A1 | | 12/2012 | Tran | |
| 2013/0117913 | A1 | | 5/2013 | Rogers | |
| 2013/0333634 | A1 | | 12/2013 | Rosenquist | |
| 2013/0340768 | A1 | | 12/2013 | Gebrewold | |
| 2014/0096348 | A1 | | 4/2014 | Anderson | |

* cited by examiner

PERSONAL PROTECTIVE DEVICE STRAP CONNECTING BUCKLE ASSEMBLY

CROSS REFERENCE TO RELATED APPLICATIONS

This application is a national stage filing under 35 U.S.C. 371 of PCT/US2015/030240, filed May 12, 2015, which claims the benefit of U.S. Application No. 62/001,859, filed May 22, 2014, the disclosure of which is incorporated by reference in its/their entirety herein.

TECHNICAL FIELD

The present disclosure relates to buckles for selectively connecting straps. More particularly, it relates to buckle assemblies for selectively connecting strap segments of a personal protection device, for example strap segments located behind a user's head when worn.

BACKGROUND

Personal protective devices often include one or more straps to secure the device in an appropriate position about a user. A particular format and construction of the strap(s) (as well as other securement devices) provided with a personal protective device are oftentimes a function of the device itself and the manner in which the device is intended to be arranged on the user and secured in place. Many personal protective devices that provide a primary body intended to be located on the user's face will include one or more straps intended to be extended or worn about the head and/or neck of the user. For example, respiratory protection devices that cover a user's nose and mouth often include one or more straps extending around the head of the user. In order to maintain a desired fit, the straps may be elastic or adjustable to a suitable length for a particular user. Various strap retaining devices and buckles have been provided that may allow for the length or tension of the strap to be manually adjusted.

Regardless of whether provisions are made for adjusting a length or tension of the strap, users can find the process of properly locating a strap about his or her head/neck to be quite frustrating. For example, some personal protective devices incorporate a continuous, elastic strap attached at either end to a primary body intended to located on the user's face (e.g., covering the user's mouth, nose, etc.); the elastic strap is simply stretch about the user's head. Unfortunately, the single elastic strap may "catch" on the user's hair or elsewhere as the user attempts to stretch the strap about the head (as well as when attempting to remove the personal protective device). Further, the continuous, elastic strap may not provide sufficient, robust support for the personal protective device as worn (e.g., where the personal protective device is relatively heavy).

With other devices providing a primary body intended to be located on the user's face (e.g., respiratory protection devices), straps extend from opposing sides of the primary body. To wear the device, the user must connect the loose ends of these straps to one another behind the user's head. In a most basic form, the user may be asked to tie the straps to one another.

Alternatively, a mechanical connection mechanism can be provided with the strap segments, such as a mechanical fastener. Typically, the mechanical connection mechanism is reversible, and entails a male member carried by one strap along with a corresponding female member carried by the second strap. The straps are connected to one another by attaching the male member to the female member. Examples of conventional mechanical connection mechanisms include metal snaps, hook and loop, etc.

Regardless of the connection mechanism format, in many instances, the user is required to complete the attachment by handling and manipulating the strap segments relative to one another while they are located behind the user's head and/or neck. This can be a difficult task as the user is required to effectuate a blind connection in a somewhat awkward position. The user cannot visually confirm whether the male and female members are correctly aligned, and thus may be unsure if an appropriate attachment has been achieved. Further, the user will be unaware of hair or skin inadvertently located between the male and female member, leading to painful pinching when the male and female members are forced together. Also, when attempting to disconnect the straps from one another, the user is once again required to blindly manipulate the connection mechanism; while a connection mechanism configured to provide a robust connection is no doubt beneficial in firmly securing the personal protective device in place, this same robust connection can render the task of disconnecting the male and female members from behind the user's head or neck quite difficult. Moreover, while efforts have been made to provide a connection mechanism formatted for ease of use when located behind the neck, significant portions of the straps are often left exposed and directly contact the user's neck and/or head. Where the strap segments are formed of an elastic material, the exposed material can cause skin irritation, especially where the user is operating in a gritty or wet environment.

In light of the above, a need exists for a strap connection assembly useful with personal protective devices that facilitates simple, behind-the-neck or behind-the-neck strap connection.

SUMMARY

Some aspects of the present disclosure relate to a buckle assembly for selectively connecting first and second straps of a personal protective device. The buckle assembly includes a receiver member and a latch member. The receiver member is configured for coupling to the first strap and includes a platform, a head, and a release arm. The platform defines a receiving surface and opposing, first and second ends. The head is disposed over the receiving surface and defines a capture surface facing the second end. In this regard, the head is spaced from the receiving surface such that the head and the receiving surface collectively define at least a portion of a slot. The release arm is pivotally connected to the head adjacent the second end. The release arm extends above the receiving surface and terminates at an actuator surface that is spaced from the capture surface. The latch member is configured for coupling to the second strap and includes a base and a latch tab. The base defines a leading end opposite a trailing end, and further defines an aperture. The latch tab is pivotally connected to the base adjacent the leading end, with the latch tab extending within the aperture and terminating at a latch face. The buckle assembly is configured to provide a latched state in which the latch member is disposed within the slot and the latch face is engaged with the capture surface. The latched state further includes the release arm disposed over a portion of the latch tab. The buckle assembly is further configured to be transitioned by a user from the latched state to a released state in which the latch face is disengaged from the capture surface in response to an actuation force applied to the actuator surface. With this construction, a user can easily and quickly release the buckle assembly by simply pressing on the actuator surface of the release arm, causing the latch tab to disengage. In some embodiments, the receiver member and the latch member incorporate various, complimentary guide surfaces that promote easy insertion of the latch member into the receiver member. In other embodiments, the receiver member and the latch member are relatively large and provide smooth interior surface that come into contact with a user's skin when worn, thereby limiting the level of strap-to-skin interface.

Other aspects of the present disclosure relate to a personal protective device including a mask body, first and second straps, and a buckle assembly. The mask body is adapted to be worn on a face of a user. The first and second straps extend from opposite sides of the mask body. The buckle assembly includes the receiver member and the latch member as described above, and are coupled to the first and second straps, respectively. With this configuration, straps can extend about a user's neck, with the buckle assembly being easily latched/unlatched while located behind the user's neck.

DETAILED DESCRIPTION

The present disclosure provides a buckle assembly for selectively connecting straps of a personal protective device. The buckle assembly includes a receiver member and a latch member configured to selectively engage one another in a latched state. The receiver member and the latch member are each configured for coupling to a separate strap included with the personal protective device, and serve to selectively connect the straps to one another. An exemplary buckle assembly of the present disclosure is easy to connect and release by a user otherwise manipulating the members "blind" behind the user's head or neck. An exemplary buckle assembly of the present disclosure promotes a user's hands remaining in continuous contact with the receiver and latch members throughout the connect/release process.

Figure 1:
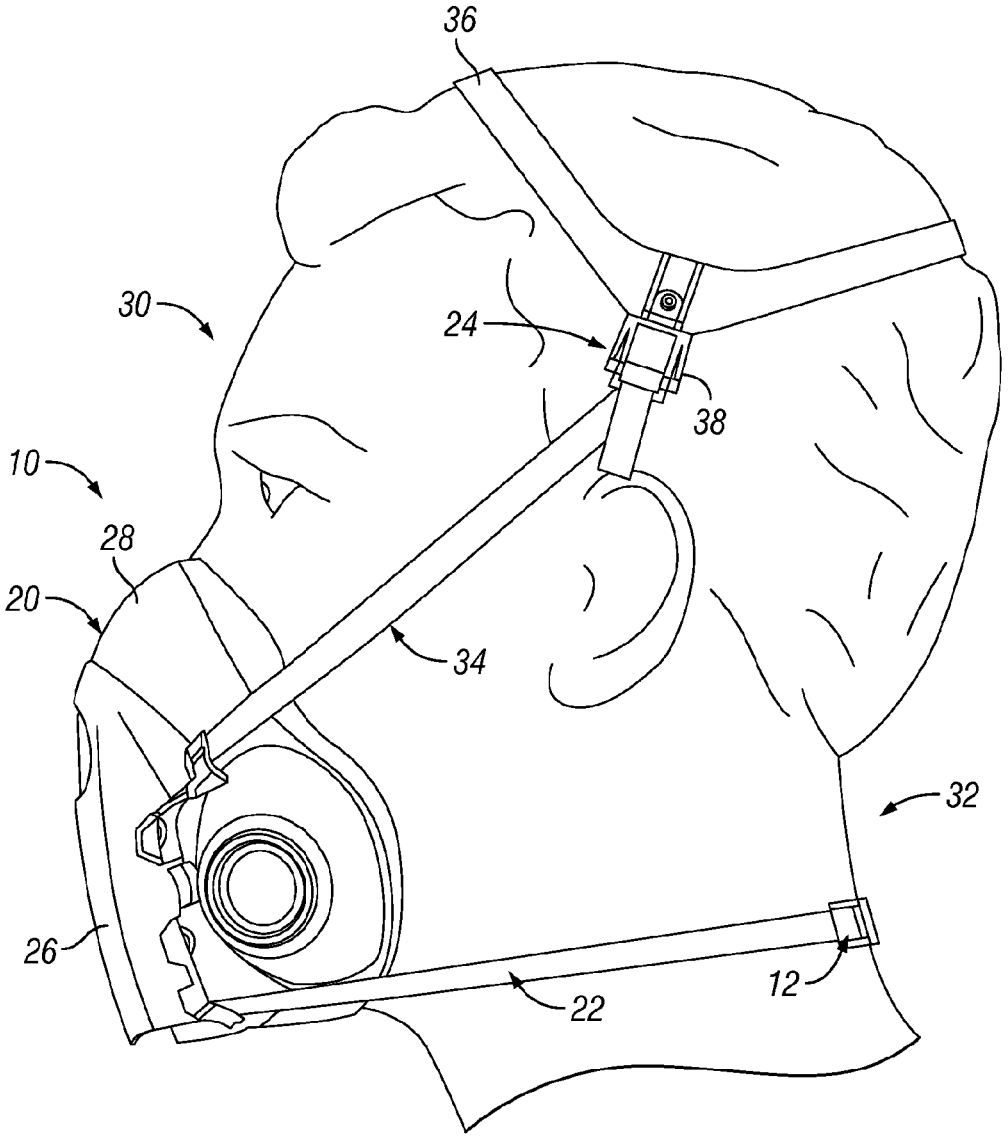
FIG. 1 is a simplified side view of a personal protective device as worn by a user and including a buckle assembly in accordance with principles of the present disclosure.

The buckle assemblies of the present disclosure are useful with a number of different personal protective device formats. FIG. 1 illustrates one non-limiting example of a personal protective device 10 incorporating a buckle assembly 12 in accordance with principles of the present disclosure. With the embodiment of FIG. 1, the personal protective device 10 is a respiratory protection device including a mask body 20, straps 22 and an optional harness assembly 24. The mask body 20 can include a rigid or semi-rigid portion 26 and a face contacting portion 28. The face contacting portion 28 can be formed of a soft or compliant material that provides a comfortable fit and is able to seal against the face of a wearer 30 to prevent ingress of external air. The straps 22 (along with the harness assembly 24) assist in securing the respiratory protection device 10 in a position of use over the nose and mouth of the wearer 30. FIG. 1 reflects that the buckle assembly 12 is associated with the strap 22. It will be understood that the straps 22 include two discrete, individual straps (one of which is visible in FIG. 1) that are each attached to opposite sides of the mask body 20. The buckle assembly 12 selectively connects the straps 22 to one another at a rear or back region 32 (referenced generally) of the head or neck of the wearer 30 as described in greater detail below.

The exemplary buckle assembly 12 of the present disclosure is equally useful with personal protective devices that are secured to the wearer 30 only by the straps 22. With the non-limiting embodiment of FIG. 1, however, the harness assembly 24 is also provided and can include one or more straps, such as harness straps 34, to secure the respiratory protection device 10 in a position of use over the nose and mouth of the wearer 30. Each of the harness straps 34 may combine with a respective one of the straps 22 to be portions of a single continuous integral strap that passes through a loop or attachment element of the mask body 20, or may be discrete individual straps that are each attached to the mask body 20. In an exemplary embodiment, the harness assembly 22 further includes a strap support 36 configured to fit generally about the crown of a head of the wearer 30. The strap support 36 may be made of any suitable material, and in some embodiments may be a head covering such as a cap, hard hat, hood, beanie, netting, or other suitable strap support. The harness straps 34 (one of which is visible in FIG. 1) are each connected to the strap support 36 by a strap retaining device 38 that, in some embodiments, can be akin to the buckle assembly 12. Regardless, the straps 22 and/or the harness straps 34 may be appropriately tensioned such that the face contacting portion 28 of the mask body 20 is adequately positioned and/or sealed against the face of the wearer 30.

Figure 2:
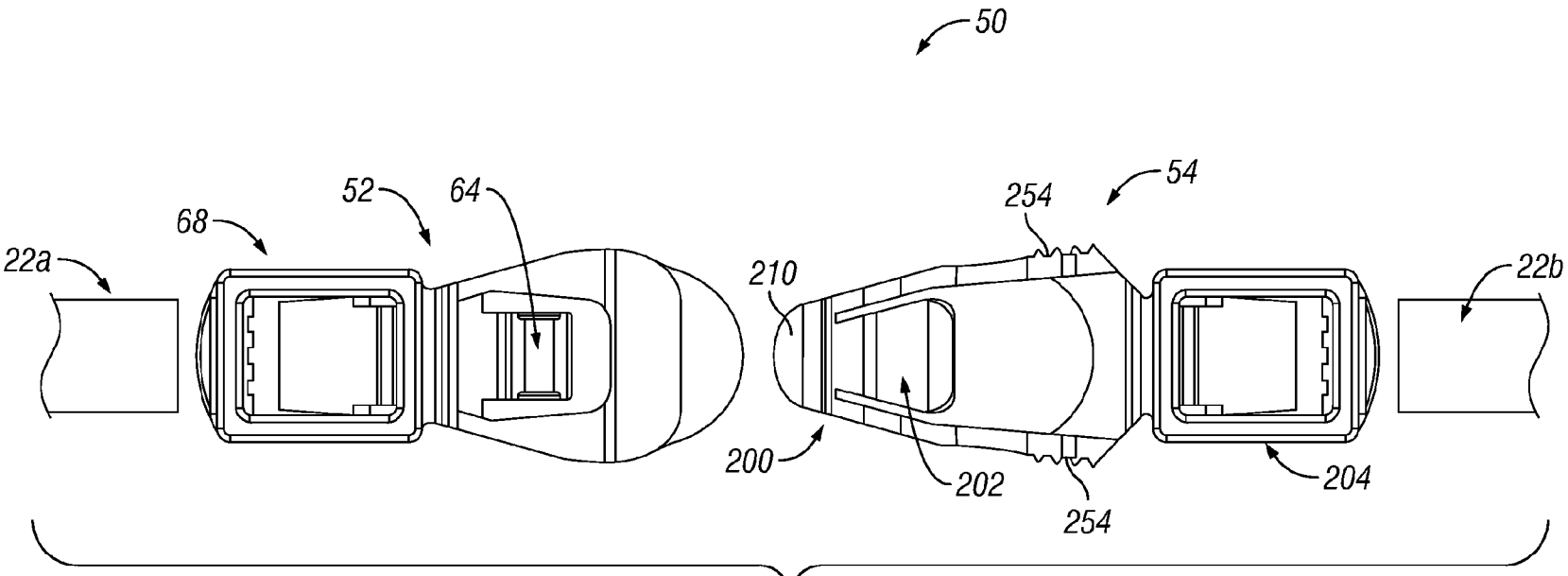
FIG. 2 is a top view of a buckle assembly in accordance with principles of the present disclosure and useful with the personal protective device of FIG. 1, along with portions of two straps.

FIG. 2 illustrates one exemplary embodiment of a buckle assembly 50 in accordance with principles of the present disclosure and useful as the buckle assembly 12 (FIG. 1), in conjunction with portions of two straps 22*a*, 22*b*. The buckle assembly 50 includes a receiver member 52 and a latch member 54. Details on the various components are provided below. In general terms, however, the receiver member 52 and the latch member 54 are each configured for coupling to a respective one of the straps 22*a*, 22*b*. Further, the receiver and latch members 52, 54 incorporate complimentary features that facilitate transitioning of the buckle assembly 50 by a user from the detached state of FIG. 2 (in which the receiver and latch members 52, 54 are separated from one another) to a latched state in which the latch member 54 is locked or latched to the receiver member 52, thus connecting the first and second straps 22*a*, 22*b*. Further, the receiver and latch members 52, 54 incorporate complimentary features that facilitate transitioning of the buckle assembly 50 from the latched state to a released state in which the latch member 54 can be removed or withdrawn from the receiver member 52 (and/or vice-versa), thus disconnecting the straps 22*a*, 22*b*.

Figure 3A:
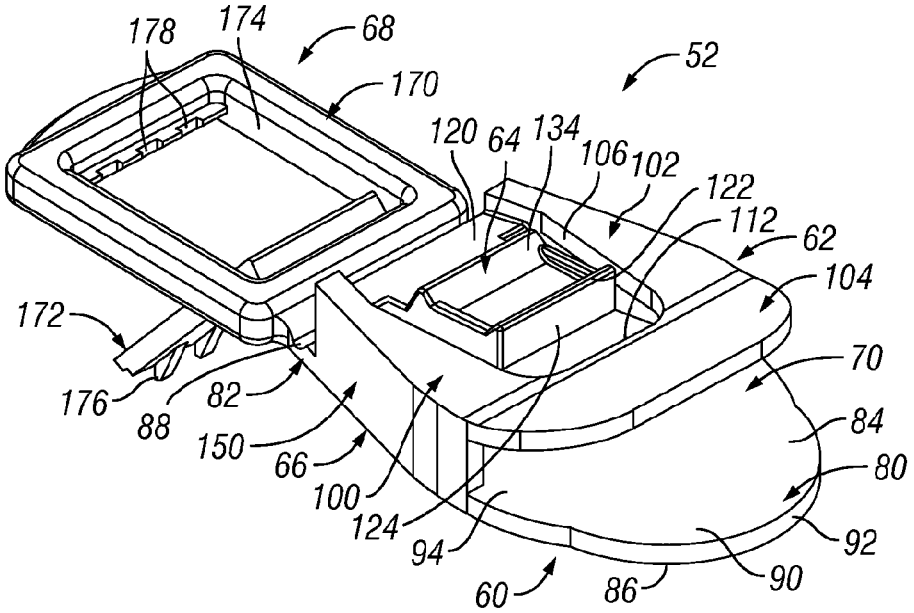
FIG. 3A is a perspective view of a receiver member of the buckle assembly of FIG. 2.
Figure 3B:
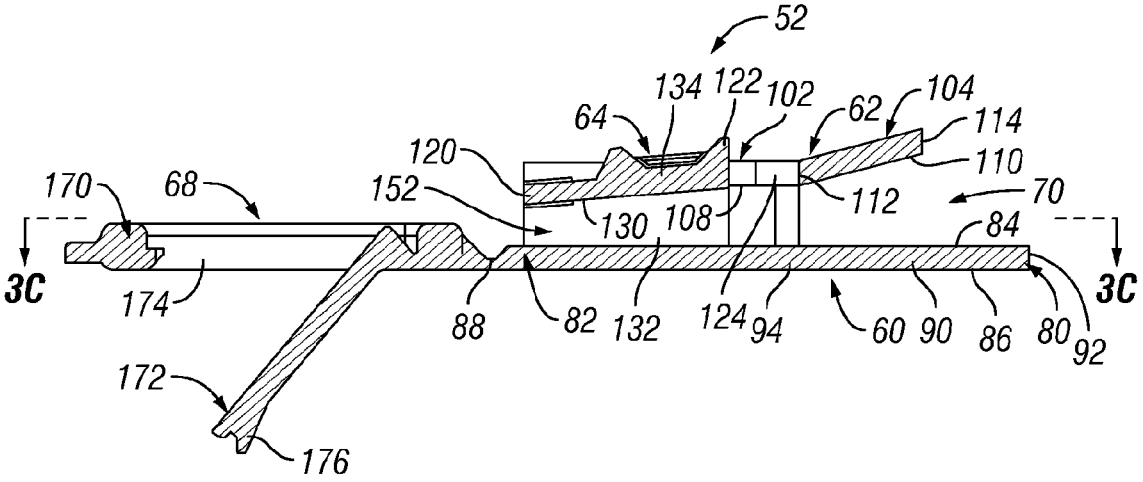
FIG. 3B is a longitudinal cross-sectional view of the receiver member of FIG. 3A.

The receiver member 52 is shown in greater detail in FIGS. 3A and 3B. In an exemplary embodiment, the receiver member 52 is an integrally formed, homogenous body defining or forming a platform 60, a head 62, a release arm 64, an optional frame 66 (referenced generally), and a strap retaining device 68. As described in greater detail below, a guide slot 70 is defined between the platform 60, the head 62 and optionally the frame 66 for receiving a corresponding component of the latch member 54 (FIG. 2). The release arm 64 is located and configured to interface with latch member 54 upon insertion into the guide slot 70. Finally, the strap retaining device 68 can assume a wide variety of forms generally configured to selectively retain a strap (such as the strap 22*a* of FIG. 2).

The platform 60 defines opposing first and second ends 80, 82, and a receiving surface 84 opposite a contact surface 86. As a point of reference, the first end 80 serves as an entrance side of the receiver member 52 at which the latch member 54 is inserted into the receiver member 52 as reflected by FIG. 2. The strap retaining device 68 is connected to the second end 82, for example at an optional living hinge 88. The receiving surface 84 is substantially planar (e.g., within 10% of a truly planar surface) in some embodiments, and is configured to slidably receive the latch member 54 as described below. The contact surface 86 can also be substantially planar, and in some exemplary embodiments, is substantially smooth for contacting a wearer's skin with minimal irritation.

The platform 60 can have a variety of shapes, and in some embodiments defines a nose region 90 adjacent the first end 80. A perimeter edge 92 of the nose region 90 at the first end 80 can have the curved shape as shown for reasons made clear below. With this exemplary construction, the nose region 90 expands in width in extension form the first end 80 in a direction of the second end 82. The platform 60 further defines an intermediate region 94 extending from the nose region 90 to the second end 82. In some embodiments, the platform 60 is shaped such that the intermediate region 94 tapers in width from the nose region 90 to the second end 82.

The head 62 is disposed over, and is spaced from, the receiving surface 84. The head 62 includes or defines opposing support segments 100, 102 and a guide segment 104. The support segments 100, 102 are directly connected to the platform 60 by the frame 66 as described below, and generally support the guide segment 104 relative to the platform 60. The support segments 100, 102 generally extend from a location aligned with or adjacent the second end 82 in a direction of the first end 80. The support segments 100, 102 can be identical or substantially identical in size and shape, and are laterally separated from one another by a notch 106. A size and shape of the notch 106 generally corresponds with features of the latch member 54 (FIG. 2) as described below. Further, an interior surface 108 (that otherwise faces the receiving surface 84) of each of the support members 100, 102 can be substantially planar (e.g., within 10% of a truly planar surface) as generally reflected by FIG. 3B.

The guide segment 104 is not directly connected to the platform 60 in some embodiments, and defines a guide surface 110 and a capture surface 112. As best shown in FIG. 3B, the guide surface 110 faces the receiving surface 84 and extends in an angular fashion relative to the receiving surface 84 from the support members 100, 102 (one of which is visible in FIG. 3B) to a tip end 114 in defining a portion of the slot guide 70. In this regard, the angular arrangement of the guide surface 110 relative to the receiving surface 84 is such that in some embodiments, a height of the guide slot 70 (i.e., distance between the receiving and guide surfaces 84, 110) tapers from the tip end 114 in a direction of the capture surface 112. This optional tapering height promotes ease of insertion of the latch member 54 (FIG. 2) into the guide slot 70. In some embodiments, the tapering height of the guide slot 70 can be established by the guide surface 110 being substantially planar (e.g., within 10% of a truly planar surface), with a major plane of the guide surface 110 and a major plane of the receiving surface 84 combining to define an included angle in the range of 5°-45°, alternatively in the range of 10°-30°. Other geometries are also acceptable, and in other embodiments, the receiving surface 84 and the guide surface 110 being substantially parallel. Regardless, the guide segment 104 can be arranged related to the platform 60 such that the tip end 114 of the head 62 is longitudinally offset from the first end 80 of the platform 60 in a direction of the second end 82. With this optional construction, the nose region 90 of the platform 60 is "exposed" relative to the head 62 and provides an easily located surface for initial placement of the latch member 52.

With reference to FIGS. 3A and 3B, the capture surface 112 is generally configured to selectively engage a corresponding feature of the latch member 54 (FIG. 2) as described below, and in some embodiments, serves as a terminal edge of the notch 106. The capture surface 112 is located opposite the tip end 114, and faces the second end 84 of the platform 60. A size and shape of the capture surface 112 can vary as a function of a size and shape of the complimentary component(s) of the latch member 54, and in some embodiments is substantially planar (e.g., within 10% of a truly planar surface). Further, and as best reflected by FIG. 3B, in some embodiments a major plane of the capture surface 112 is substantially perpendicular to the major plane of the receiving surface 84 (e.g., within 10 degrees of a truly perpendicular relationship), at least in a region at which capture surface 112 overlies the receiving surface 84.

The release arm 64 is generally located between the support segments 100, 102, and defines a pivot end 120 and a free end 122. The pivot end 120 is pivotally connected relative to the head 62 (e.g., is pivotally connected to the frame 66) adjacent the second end 82. The release arm 64 extends from the second end 82 in a direction of the first end 80, terminating at the free end 122. At least a portion of the release arm 64 is disposed within the notch 106 (e.g., a width of the release arm 64 is less than a width of the notch 106), and the free end 122 is longitudinally spaced from the capture surface 112 by a gap 124. A size of the gap 124 (e.g., longitudinal distance between the free end 122 and the capture surface 112) corresponds with features of the latch member 54 (FIG. 2) for reasons made clear below.

In an exemplary embodiment, the release arm 64 further forms or defines an engagement surface 130. As best reflected by FIG. 3B, the release arm 64 is arranged such that the engagement surface 130 faces, but is laterally spaced from, the receiving surface 84 of the platform 60 to define an engagement slot 132. The engagement surface 130 is generally configured to interface with corresponding features of the latch member 54 (FIG. 2) as described below, and in some embodiments is substantially planar (e.g., within 10% of a truly planar surface). As indicated above, while the release arm 64 can pivot relative to the platform 60 and the head 62 (e.g., pivoting about the pivot end 120), in some embodiments, the receiver member 52 is configured to provide a neutral or normal condition illustrated in the views of the release arm 64 relative to the platform 60 and the head 62. The release arm 64 can be manipulated from the neutral condition in response to a user-applied actuation force as described below, but upon removal of the actuation force, will naturally self-return or self-revert to the neutral condition. With this in mind, in some embodiments the receiver member 52 is configured such that in the neutral condition, the engagement surface 130 is arranged at an angle (e.g., non-parallel) relative to the receiving surface 84 such that the engagement slot 132 tapers in height from the free end 122 to the pivot end 120. For example, a major plane of the engagement surface 130 and a major plane of the receiving surface 84 can combine to define an included angle in the range of 5°-25°. A tapered shape of the engagement slot 132 can correspond with geometries of the latch member 54 for reasons made clear below. Regardless, in exemplary embodiments, a height of the engagement slot 130 is less than that of the guide slot 70 (i.e., a distance between the engagement surface 130 and the receiving surface 84 is less than a distance between the interior surface 108 of the guide segments 104 and the receiving surface 84). The engagement slot 132 is open at the pivot end 120 as well as the free end 122 in some embodiments.

In an exemplary embodiment, the release arm 64 incorporates one or more features that assist a user in applying an actuating force. For example, the release arm 64 can form or define an actuator surface 134. The actuator surface 134 is located opposite the pivot end 120 (i.e., adjacent the free end 122) and thus represents an appropriate location for a user-applied force to effectuate pivoting movement of the release arm 64. The actuator surface 134 is defined opposite the engagement surface 130, and can include one more features that promote tactile recognition thereof. For example, the actuator surface 134 can include opposing ribs that are separated by a groove. The ribs represent outward projections in the actuator surface 134, and the groove is generally sized and shaped to ergonomically receive an adult fingertip or thumb. With this exemplary construction then, a user is provided with a tactile confirmation that his or her finger/thumb is located at the actuator surface 134 when "feeling" the ribs and the groove. The actuator surface 134 can assume other forms, and in other embodiments, tactile-related features are omitted.

Figure 3C:
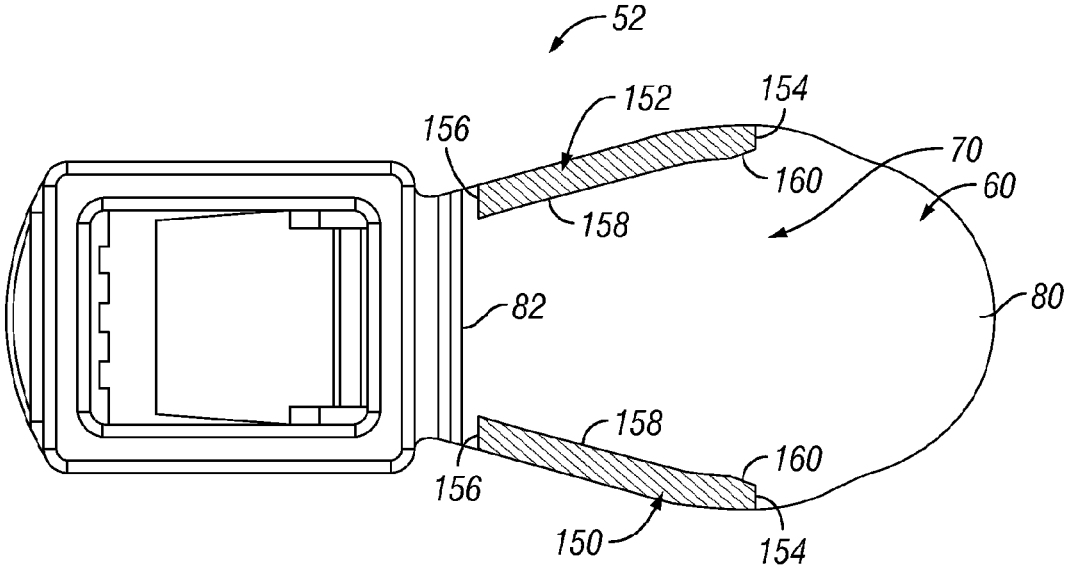
FIG. 3C is a cross-sectional view of the receiver member of FIG. 3B, taken along the line 3C-3C.

The frame 66 can assume a variety of forms appropriate for supporting one or both of the head 62 and the release arm 54 relative to the platform 60. In some embodiments, the frame 66 can include opposing walls 150, 152 that project from the receiving surface 84 of the platform. The cross-sectional view of FIG. 3C illustrates one embodiment of the walls 150, 152 in greater detail, and reflects that the walls 150, 152 can be substantially identical in some embodiments. Each of the walls 150, 152 forms or defines an entrance end 154 opposite an exit end 156, along with an inner surface 158. The exit end 156 is located adjacent the second end 82 of the platform 60, with the walls 150, 152 extending in a direction of the first end 80. In some embodiments, the terminal entrance end 154 is longitudinally offset from the first end 80 (in a direction of the second end 82), approximately spatially aligned with the capture surface 112 (FIG. 3B). A spacing between the inner surface 158 of the walls 150, 152 defines a width of the guide slot 70 (with FIG. 3B reflecting that the guide slot 70 is further bounded by the head 62 beyond the entrance end 154). In some embodiments, the walls 150, 152 are arranged such that the guide slot 70 tapers in width from the entrance end 154 to the exit end 156, with a size and shape of the guide slot 70 (in the width direction) corresponding with features of the latch member 54 (FIG. 2). As described below, coupling of the latch member 54 with the receiver member 52 includes the latch member 54 being inserted at the entrance end 154 of the walls 150, 152 and sliding along the inner surface 158 of one or both of the walls 150, 152. With this in mind, exemplary embodiments optionally include the inner surface 158 of each wall 150, 152 defining a recess 160 at the corresponding entrance end 154. The recess 160, where provided, can assist in self-guiding the latch member 54 into the guide slot 70 as it is inserted between the walls 150, 152. Regardless, in some embodiments, the inner surface 158 of each of the walls 150, 152 can be substantially flat or smooth (e.g., within 10% of a truly flat surface) to better promote a sliding interface with the latch member 54.

Returning to FIGS. 3A and 3B, the strap retaining device 68 can assume a number of different forms that may or may not be implicated by the FIGURES and appropriate for coupling with the strap 22*a* (FIG. 2). In one non-limiting embodiment, the strap retaining device 68 can include or define framework 170 and a tongue 172. The framework 170 generally defines an aperture 174 sized to receive the strap 22*a*. The tongue 172 projects from the framework 170, and is configured to selectively secure the strap 22*a* within the aperture 174. For example, the tongue 172 can be pivotally connected to the framework 170, and forms teeth 176 that selectively interface with channels 178 in the framework 170. A plethora of other strap retaining device constructions are equally acceptable.

Figure 4A:
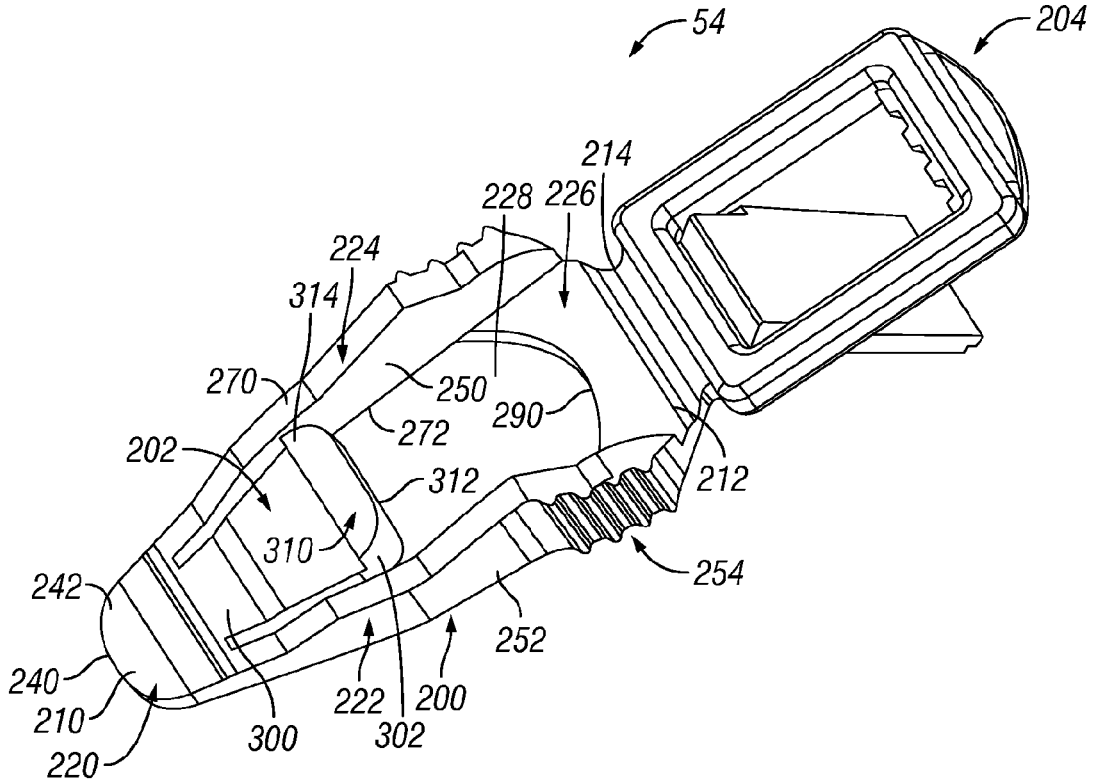
FIG. 4A is a perspective view of a latch member of the buckle assembly of FIG. 2.
Figure 4B:
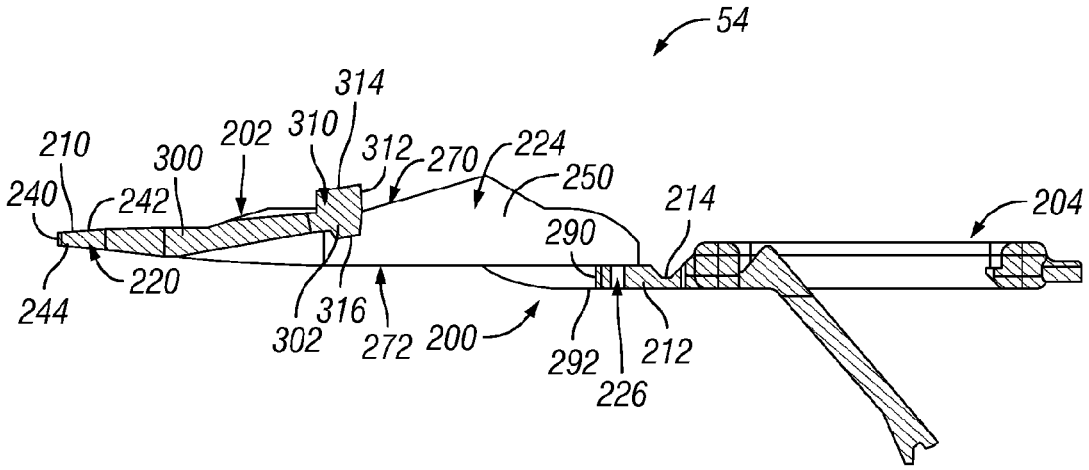
FIG. 4B is a longitudinal cross-sectional view of the latch member of FIG. 4A.

The latch member 54 is shown in greater detail in FIGS. 4A and 4B. In an exemplary embodiment, the latch member 54 is an integrally formed, homogenous body defining or forming a base 200, a latch tab 202, and a strap retaining device 204. As described in greater detail below, the base 200 is configured for insertion into the receiver member 52 (FIG. 2). The latch tab 202 is pivotally connected to the base 200, and is configured to selectively engage a corresponding feature(s) of the receiver member 52. Finally, the strap retaining device 204 can assume any of the forms described above with respect to the strap retaining device 68 (FIG. 3A), and is generally configured to selectively retain a strap (such as the strap 22*b* of FIG. 2).

The base 200 defines a leading end 210 opposite a trailing end 212. As a point of reference, the leading end 210 serves as an insertion side of the latch member 54 at which the latch member 54 is initially inserted into the receiver member 52 (as reflected by FIG. 2). The strap retaining device 204 is connected to the trailing end 212, for example at an optional living hinge 214. An overall size and shape of the base 200 corresponds with various geometries of the receiver member 52, and can be collectively defined by a shoulder 220, opposing arms 222, 224, and a foot 226. The arms 222, 224 extend between the shoulder 220 and the foot 226, optionally defining an aperture 228.

The shoulder 220 defines the leading end 210, and in some embodiments provides a curved leading edge 240. The shoulder 220 is configured to promote easy insertion into the guide and engagement slots 70, 132 (FIG. 3B) of the receiver member 52 (FIG. 3B), including having a width that is less than a minimum width of either of the guide or engagement slots 70, 132. Further, in some embodiments, the shoulder 220 slightly tapers in height in extension from the arms 222, 224 to the leading edge 240 as best reflected by FIG. 4B. For example, the shoulder 220 defines opposing, upper and lower faces 242, 244 that can converge toward one another in a direction of the leading edge 240. While the lower face 244 is optionally substantially planar (e.g., within in 10% of a truly planar surface), in some embodiments the lower face 244 is non-planar relative to other lower faces of the base 200 for reasons made clear below.

The arms 222, 224 can, in some embodiments, be identical, and collectively define the base 200 to have an increasing width in a direction of the trailing end 212. Each of the arms 222, 224 defines an interior side 250 and an exterior side 252. The arms 222, 224 are arranged such that the interior sides 250 face one another to define a width of the aperture 228. One or both of the arms 222, 224 optionally incorporate features that promote user handling of the latch member 54 along the exterior sides 252. For example, in an exemplary embodiment, the arms 222, 224 each include a serrated grip region 254 along the corresponding exterior side 252 at or adjacent the trailing end 212 (e.g., longitudinally spaced from the latch tab 202). The serrated grip region 254 can assume a variety of forms conducive to ergonomic gripping thereof by a user's finger(s) and/or thumb, such as the spaced ridges shown. In other embodiments, a discernable grip feature can be omitted from one or both of the arms 222, 224.

Figure 4C:
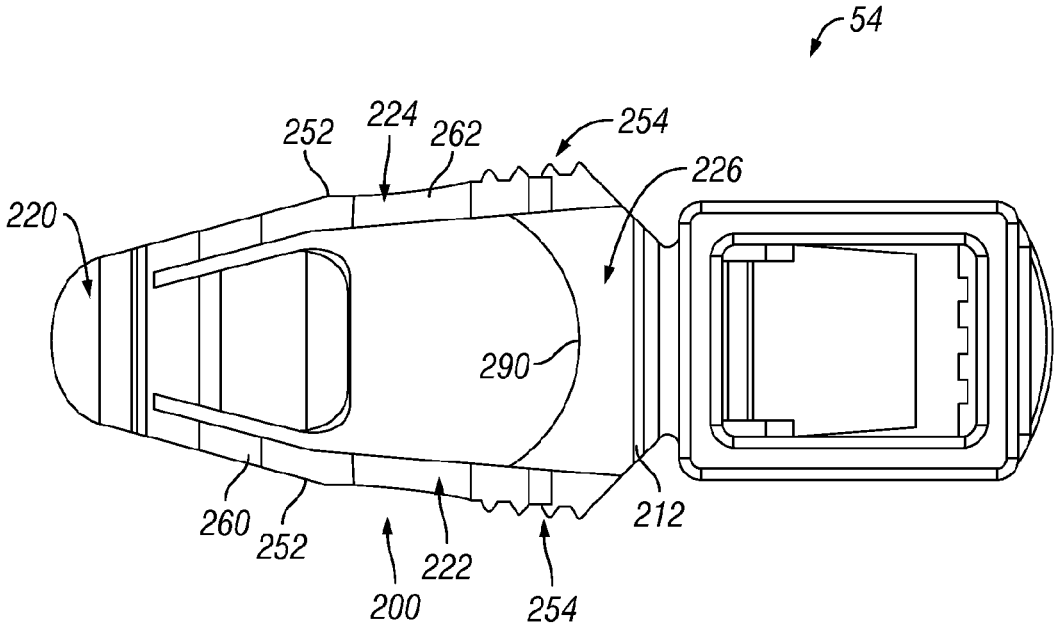
FIG. 4C is a top plan view of the latch member of FIG. 4A.

A width of the base 200 as collectively defined by the arms 222, 224 is further illustrated in the view of FIG. 4C, and in some embodiments is selected to correspond with geometries of the receiver member guide slot 70 (FIG. 3B). In this regard, the width of the base 200 can be described with reference to a leading region 260 and a trailing region 262. The leading region 260 is defined by an extension of the arms 222, 224 from the shoulder 220 in a direction of the trailing end 212, and generally follows the expanding width defined along the shoulder 220. A width along the leading region 260 is less than the corresponding maximum width of the receiver member guide slot 70 (FIG. 3C). The trailing region 262 extends from the leading region 260, and also has an increasing width in a direction of the trailing end 212. However, in some embodiments, the increasing width is less pronounced along the trailing region 262 as compared to the leading region 260. For example, an included angle defined by the exterior sides 252 of the arms 222, 224 along the trailing region 262 being less than an included angle defined by the exterior sides 252 along the leading region 260. Other geometries are also acceptable. In some embodiments, the base 200 is configured such that at or about the point of transition from the leading region 260 to the trailing region 262, the width of the base 200 becomes greater than a maximum width of the guide slot 70. With this construction, and as made clear below, the latch member 54 can be appropriately engaged to the receiver member 52 (FIG. 2) and the increased-width trailing region 262 projects beyond the receiver member 52 to provide enhanced or enlarged surface areas (e.g., the serrated grip regions 254) that can be readily grasped and manipulated by a user.

Returning to FIGS. 4A and 4B, the arms 222, 224 each further define an upper face 270 opposite a lower face 272, with a height of each of the arms 222, 224 being defined between the two faces. Optional geometries provided by the upper and lower faces 270, 272 are identified for the first arm 222 in FIG. 4D. The upper face 270 can include or define an insertion region 274, a stepped region 276, a transition region 278 and a stop region 280. The lower face 272 can include or define a guide region 282 and a bearing region 284. In general terms, the insertion region 274 of the upper face 270 and the guide region 282 of the lower face 272 continue the spatial orientation of the upper and lower faces 242, 244, respectively, of the shoulder 220. The stepped region 276 extends upwardly (relative to the orientation of FIG. 4D) from the insertion region 274 in a non-parallel fashion, defining a more pronounced angular orientation relative to the lower face 272 (e.g., an increase in a height of the arm 222 is more pronounced along the stepped region 276 as compared to that of the shoulder 220 and the insertion region 274). The transition region 278 extends from the stepped region 276 in a non-parallel fashion (relative to a plane of the stepped region 276), for example defining a plane that is substantially parallel with a plane of the corresponding bearing region 284 of the lower surface 272 (e.g., a plane the upper surface 270 along the transition region 278 and a plane of the lower surface 272 along the bearing region 284 are within 10 degrees of truly parallel relationship). Finally, the stop region 280 extends upwardly (relative to the orientation of FIG. 4D) from the transition region 278, combining with the lower surface 272 to define an increasing height in a direction of the trailing end 212. As described below, the stop region 280 can be substantially flat or planar in some embodiments (e.g., within 10% of a truly flat surface), and is configured for abutting interface with a corresponding surface of the receiving member 52.

Figure 4D:
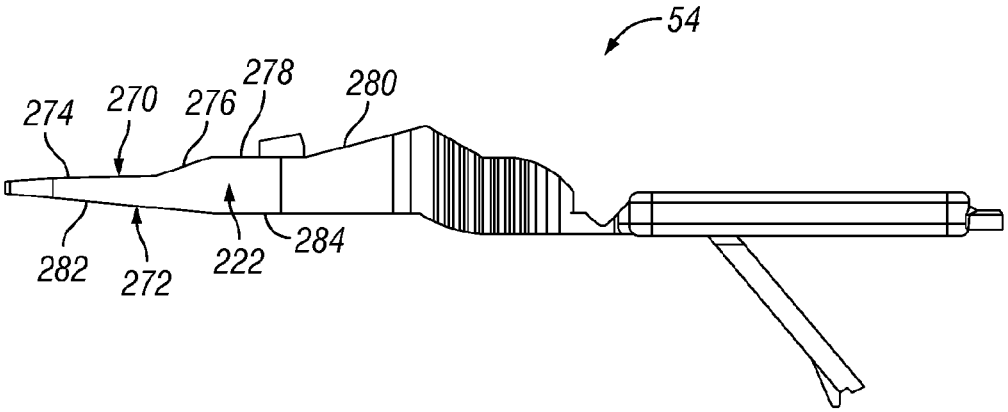
FIG. 4D is a side view of the latch member of FIG. 4A.

As reflected by FIG. 4D, a plane of the lower face 272 along the guide region 282 is non-parallel with a plane of the lower face 272 along the bearing region 284 in some embodiments. Relative to the upright orientation of FIG. 4D in which the bearing region 284 is horizontal, the guide region 282 can have an upward angular arrangement. In some embodiments, this optional angular relationship between the guide region 282 and the bearing region 284 promotes simplified initial insertion of the latch member 54 into the receiving member 52 (FIG. 2), with the bearing surface 284 dictating a desired location of the corresponding arm 222, 224 relative to the receiving member 52 upon final or complete insertion.

Returning to FIGS. 4A and 4B, the foot 226 extends between and interconnects the arms 222, 224. In an exemplary embodiment, the foot 226 defines a receiving edge 290 opposite the trailing end 212. The receiving edge 290 can have a concave or curved shape (best shown in FIG. 4C), and defines an end of the aperture 228. A shape of the receiving edge 290 can mimic or match a shape of a corresponding feature of the receiver member 52 (FIG. 2), with the foot 226 being laterally offset from the lower face 272 of the arms 222, 224 for reasons made clear below (e.g., relative to the upright orientation of FIG. 4B, a lower face 292 of the foot 226 is located "below" a plane of the lower face 272 of the arm 224).

The latch tab 202 defines and extends between a fixed end 300 and a free end 302. The fixed end 300 is connected to the shoulder 220, with the latch tab 202 arranged to extend from the shoulder 220 within the aperture 228 in a direction of the trailing end 222. In some embodiments, the latch tab 202 can pivot relative to the shoulder 220 (and thus relative to the base 200) at the fixed end 300, for example in response to a force applied along a length of the latch tab 202 adjacent the free end 302. With these and other, related embodiments, the latch member 54 is configured such that the latch tab 202 naturally assumes spatial orientation reflected in the views in a neutral or normal condition; upon removal of a force otherwise causing the latch tab 202 to articulate or pivot relative to the base 200, the latch tab 202 will naturally self-revert or self-transition back to the neutral condition shown.

The latch tab 202 optionally forms a latching body 310 at or adjacent the free end 302. The latching body 310 can represent an increased size or height of the latch tab 202 relative to a remainder thereof, and defines a latch face 312. In some embodiments, the latch tab 202 terminates at the latch face 312, with the latch face 312 configured to engage a corresponding surface of the receiver member 52 (FIG. 2) as described below. The latch face 312 is located between the leading and trailing ends 210, 212, and is longitudinally spaced from the receiving edge 290 of the foot 226 in a direction of the leading end 210. In related embodiments, the enlarged latching body 310 defines opposing, upper and lower faces 314, 316. The upper face 314 can be substantially planar (e.g., within 10% of a truly planar surface), and is spatially arranged in the normal condition to be non-parallel with the bearing region 284 of the lower face 272 of the arms 222, 224 for reasons made clear below (e.g., in the neutral condition, a plane of the latching body upper face 314 projects away from a plane of the bearing region 284 in a direction of the trailing end 212). The lower face 316 of the latching body 310 can also be substantially planar in some embodiments. Other geometries for the latch tab 202 are also envisioned.

Returning to FIG. 2, one or both of the receiver member 52 and the latch member 54 may be formed from a material having suitable properties to allow for elastic deformation over a range of normal bending and flexing while exhibiting the ability of the release arm 64 and the latch tab 202, respectively, to naturally return to the neutral conditions described above. In an exemplary embodiment, the receiver member 52 and the latch member 54 are made from polypropylene such as a material having the trade name P5M4K-046 available from Flint Hills Resources of Wichita, Kans. Other suitable materials include plastics, polyethylene, acrylonitrile butadiene styrene (ABS), metals, spring steel, other suitable materials as known in the art, and suitable combinations of such materials.

Use or operation of the buckle assembly 50 in selectively connecting the straps 22*a*, 22*b* can initially be described with reference to the detached state of FIG. 2 that otherwise reflects the receiver member 52 poised to receive the latch member 54 (it being understood that during use, the first strap 22*a* is engaged with the strap retaining device 68 of the receiver member 52, and the second strap 22*b* is engaged with the strap retaining device 204 of the latch member 54). A user grasps the receiver member 52 in one hand, and the latch member 54 in the other hand. It will be recalled that in many end-use applications, the user is manipulating the receiver member 52 and the latch member 54 at a location behind the user's head or neck; under these circumstances, the user is unlikely to see the receiver and latch members 52, 54. However, the receiver and latch members 52, 54 provide enlarged, ergonomically convenient surfaces for handing, with the latch member 54 optionally providing the serrated grip regions 254 that facilitate gripping by the user.

Figure 5A:
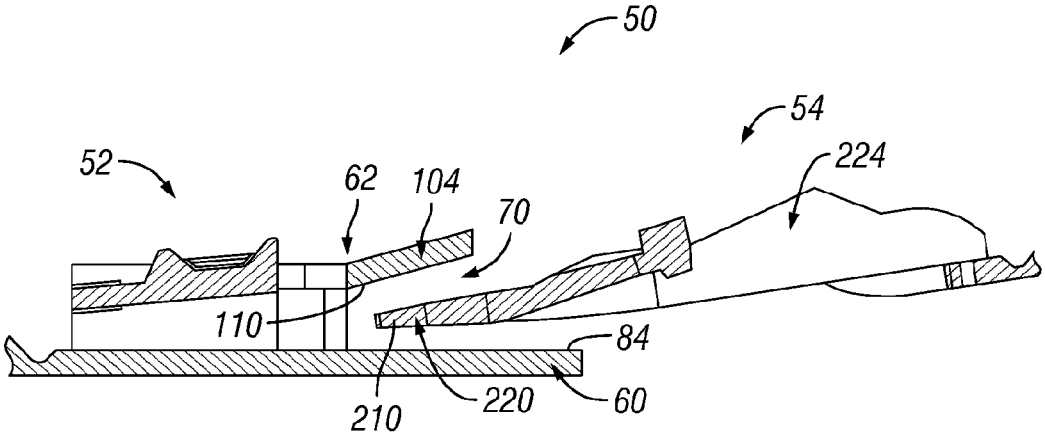
FIGS. 5A and 5B are longitudinal cross-sectional views of portions of the buckle assembly of FIG. 2 and illustrating an initial stage of insertion process of the latch member relative to the receiver member.
Figure 5B:
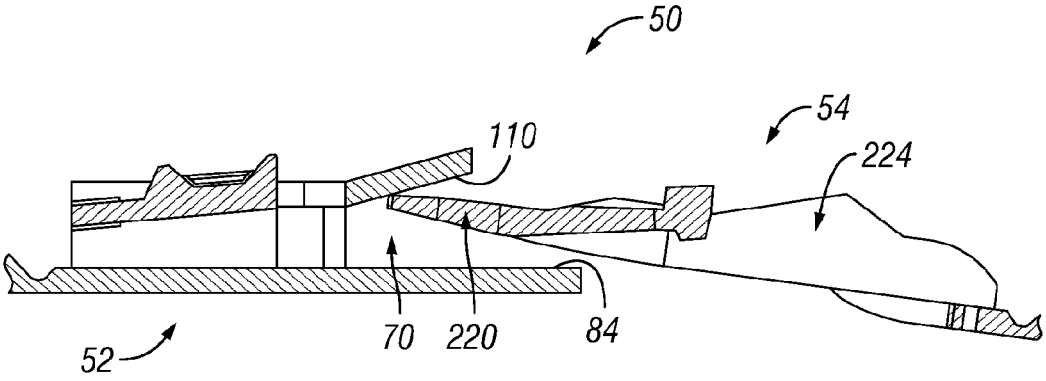

The latch member 54 is directed by the user toward the receiver member 52 (and/or vice-versa), with the receiver member 52 configured to guide the leading end 210 of the latch member base 200 into desired alignment in some embodiments. For example, the cross-sectional view of FIG. 5A illustrates the leading end 210 of the latch member 54 partially inserted into the guide slot 70 of the receiver member 52. As shown, a height of the guide slot 70 along the guide segment 104 of the head 62 is substantially greater than a height of the shoulder 220, allowing the leading end 210 to easily be inserted into the guide slot 70. Notably, the platform 60 projects beyond the guide segment 64 with the receiving surface 84 providing an ample, readily discernable landing surface for the leading end 210 (e.g., a user can readily "feel" the leading end 210 being placed into contact with the receiving surface 84, and is provided with positive tactile feedback that the latch member 54 is generally, correctly aligned with receiver member 52). As the receiver member 52 and the latch member 54 are directed into further engagement (e.g., the guide member 52 is moved rightward and/or the latch member 54 is moved leftward relative to the orientation of FIG. 5A), various possible interfaces between surfaces of the receiver and latch members 52, 54 naturally direct the receiver and latch members 52, 54 into correct alignment without requiring any visual confirmation by the user. For example, if the receiver and latch members 52, 54 become horizontally tilted and/or laterally offset relative to one another from the orientation of FIG. 5A, one or more surfaces of the latch member 54 (e.g., the upper face of the shoulder 220 and/or arms 222, 224 as described above) may be brought into contact with the guide surface 110 of the receiver member 52 as shown in FIG. 5B. Under these circumstances, the angled orientation of the guide surface 110 relative to the receiving surface 84 interfaces with the latch member 54 to naturally guide or direct the latch member 54 within the guide slot 70. A similar, natural guidance or direction is provided upon contact between the latch member 54 and the receiving surface 84.

Figure 6A:
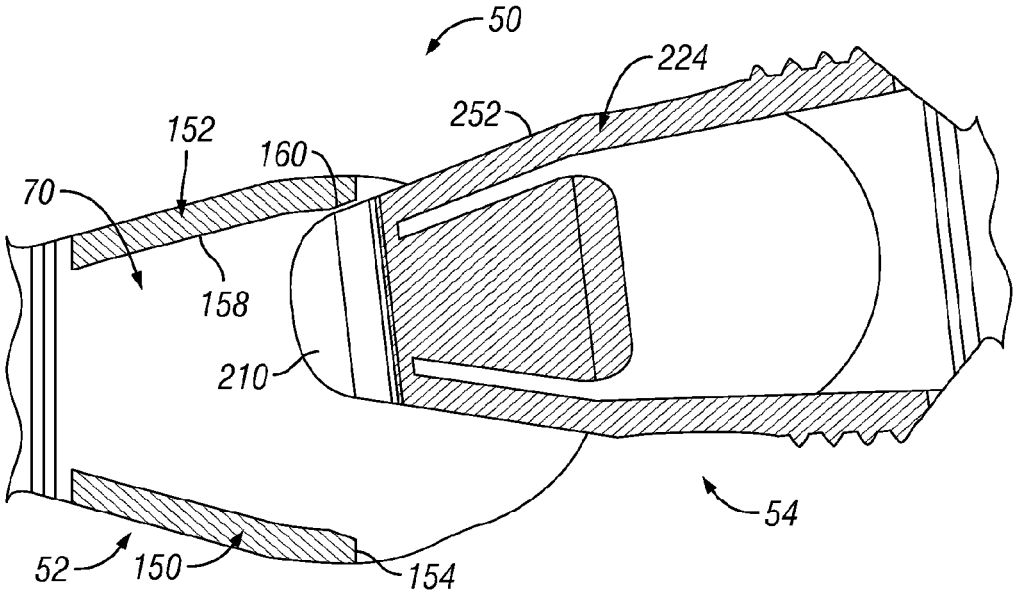
FIGS. 6A and 6B are transverse cross-sectional views of portions of the buckle assembly of FIG. 2 and illustrating stages of an insertion process of the latch member relative to the receiver member.
Figure 6B:
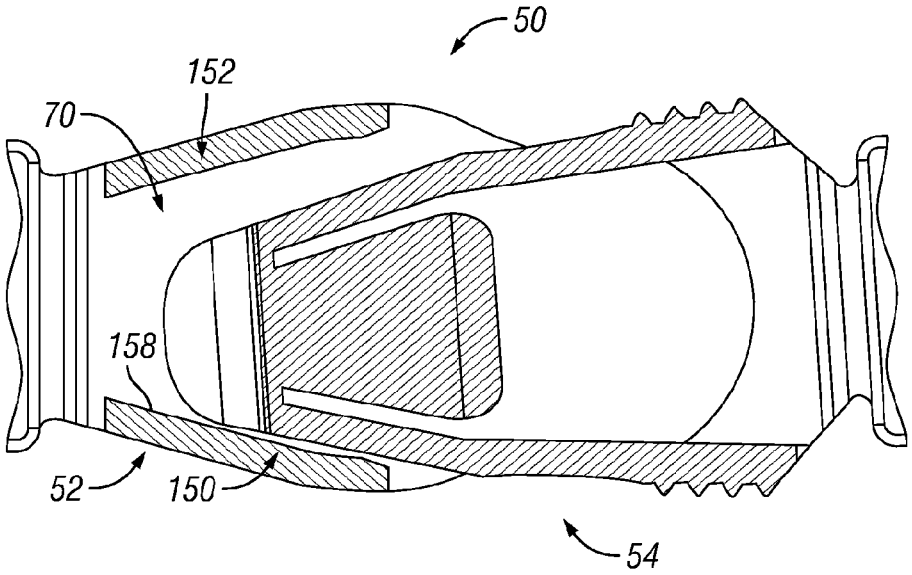

Interface between other surfaces of the receiver and latch members 52, 54 during the insertion process can also naturally affect desired, lateral alignment. For example, the cross-sectional view of FIG. 6A reflects the latch member 54 laterally misaligned with the guide slot 70 as the leading end 210 is initially directed toward the receiver member 52. As described above, a width of the guide slot 70 at the entrance end 154 of the walls 150, 152 is substantively larger than a width of the latch member 54 at the leading end 210 such that the latch member 54 is readily inserted into the guide slot 70. The latch member 54 need only be grossly aligned by the user relative to the receiver member 52; under the circumstances of FIG. 6A, the leading end 210 contacts the inclined recess 160 along the inner surface 158 of the second wall 152. With further movement of the receiver and latch members 52, 54 toward one another (i.e., the receiver member 52 moving rightward and/or the latch member 54 moving leftward relative to the orientation of FIG. 6A), surfaces of the latch member 54 (e.g., the exterior side 252 of the second arm 224) slidably interface with the inclined recess 160 (and/or other portions of the inner surface 158 of the second wall 152), with the second wall 152 thus naturally guiding or directing the latch member 54 into lateral alignment with the guide slot 70. FIG. 6B illustrates this same guided interface at a later stage of insertion, showing the latch member 54 slidably interfacing with the inner surface 158 of the first wall 150 and thus being naturally guided or directed into alignment with the guide slot 70.

The above-described sliding interfaces between the receiver member 52 and the latch member 54 render the buckle assembly 50 highly conducive to behind the head or neck operation. A user can easily achieve general, correct alignment between the members 52, 54 during the initial stages of insertion without directly viewing buckle assembly 50.

Figure 7:
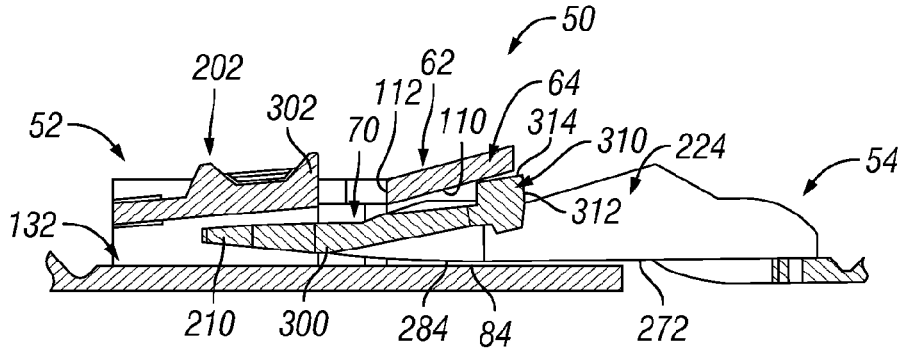
FIG. 7 is a longitudinal cross-sectional view of the buckle assembly of FIG. 2 in a latched state.

With further, guided insertion of the latch member 54 into the guide slot 70, the leading end 210 enters the engagement slot 132 as shown by the cross-sectional view of FIG. 7. As mentioned above, a height of the engagement slot 132 at the free end 302 of the latch tab 202 is substantively larger than a height of the latch member 54 at the leading end 210, such that the latch member 54 readily enters the engagement slot 132. At the stage of insertion of FIG. 7, the lower face 272 of the latch member arms 222, 224 (one of visible in FIG. 7) can be slidably interfacing with the receiving surface 84 of the receiver member 52, for example along the bearing region 284. Regardless, the latch member 54 is spatially arranged such that with further movement of the receiver and latch members 52, 54 toward one another (i.e., movement of the receiver member 52 rightward and/or movement of the latch member 54 leftward relative to the orientation of FIG. 7), the upper face 314 of the latching body 310 will begin to bear against the guide surface 110 of the receiver member guide segment 64. When the receiver and latch member 52, 54 have been sufficiently manipulated to bring latching body upper face 314 and the latch member lower face 272 into simultaneous contact with the receiver member guide and receiving surfaces 110, 84, respectively, the receiver member 52 exerts a compressive force on to the latch tab 202 (e.g., at the latching body upper face 314), causing the latch tab 202 to deflect, effectively pivoting at the fixed end 300.

Figure 8A:
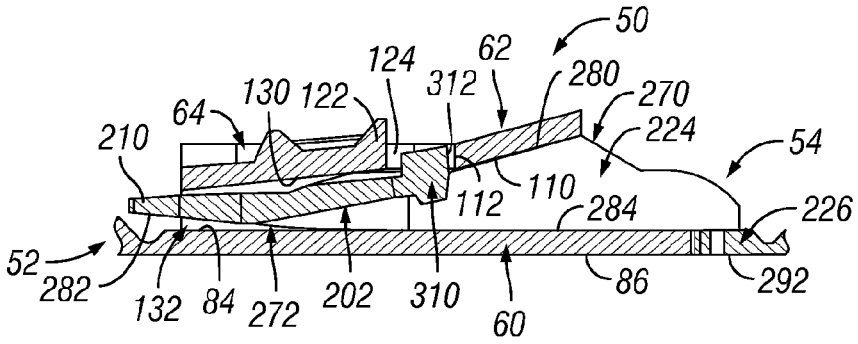
FIGS. 8A-8C are cross-sectional views of the buckle assembly of FIG. 2 in the latched state and taken along differing planes.

Increased deflection of the latch tab 202 occurs as the latch member 54 is further inserted into the guide slot 70 (from the arrangement of FIG. 7) as the latching body upper face 314 slides along the tapering guide surface 110. Once the latch member 54 has been sufficiently inserted to bring the latch tab 202 beyond the capture surface 112 of the head 62, the compressive force exerted by the receiver member 52 on to the latch tab 202 is removed, and the latch tab 202 naturally reverts back to the neutral condition. Stated otherwise, once the latch face 312 is beyond the capture surface 110, the latch tab 202 freely self-reverts back to the neutral condition. The cross-sectional view of FIG. 8A illustrates the latch tab 202 in the neutral condition, and reflects the locked state of the buckle assembly 50. In some embodiments, the buckle assembly 50 is configured such that an audible noise or "click" is generated as the latch tab 202 self-reverts to the neutral condition (e.g., as stored energy in the latch tab 202 is released when reverting to the neutral condition, a noise is generated; the latching body 310 frictionally interfaces with a surface of the head 62 when self-reverting to the neutral condition and generates a noise; etc.). In addition or alternatively, a user otherwise holding the latch member 54 can "feel" the latch tab 202 self-revert to the neutral condition. With these optional embodiments, then, the user is provided with an audible and/or tactile confirmation that the locked state has been successfully achieved. Further, the locked state can be achieved by a user while at all times maintaining contact with both the receiver and latch member 52, 54; the user simply grasps the receiver member 52 with one hand and the latch member 54 at the optional serrated grip regions 254 (FIG. 2), and directs the latch member 54 into the receiver member 52 in a single motion.

Figure 8B:
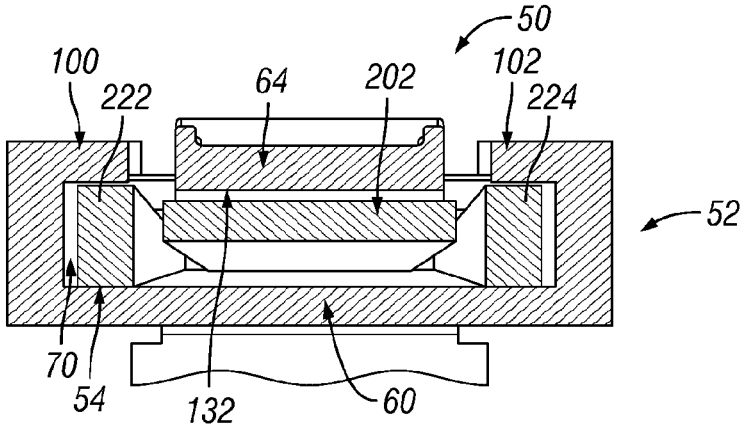

In the locked state, the latch face 312 is engaged with, or only slightly spaced from, the capture surface 112. Thus, an abutting interface between the latch face 312 and the capture surface 112 prevents the latch body 54 from being inadvertently pulled from receiver member 52 (e.g., relative to the orientation of FIG. 8A, interface between the latch face 312 and the capture surface 112 prevents the latch member 54 being overtly moved rightward relative to the receiver member 52). The lower face 272 of the latch member arms 222, 224 (one of which is visible in FIG. 8A), and in particular the bearing region 284, abuts or bears against the receiver member receiving surface 84. In an exemplary embodiment, corresponding geometries of the receiver and latch members 52, 54 locates the upper face 270 of the latch member arms 222, 224, and in particular the stop region 280, flush with the guide surface 110 of the receiver member 52, with this interface impeding or preventing further forward movement of the latch member 54 relative to the receiver member 52 (i.e., leftward relative to the orientation of FIG. 8A). FIG. 8A further reflects that in the locked state of the buckle assembly 50 (including the latch tab 202 in the neutral condition), the gap 124 between the free end 122 of the release arm 64 and the capture surface 112 is sufficiently sized to freely receive the latching body 310. Further, the release arm 64 of the receiver member 52 extends over the latch tab 202, with the engagement surface 130 being slightly spaced above the corresponding portions of the latch tab 202. This relationship is further illustrated in the cross-sectional view of FIG. 8B. As shown, in the locked state, the latch tab 202 resides within the engagement slot 132, whereas the opposing arms 222, 224 of the latch member 52 are located outside of the engagement slot 132 and are within the guide slot 70 as defined between the receiver member support segments 100, 102 and the platform 60.

Figure 8C:
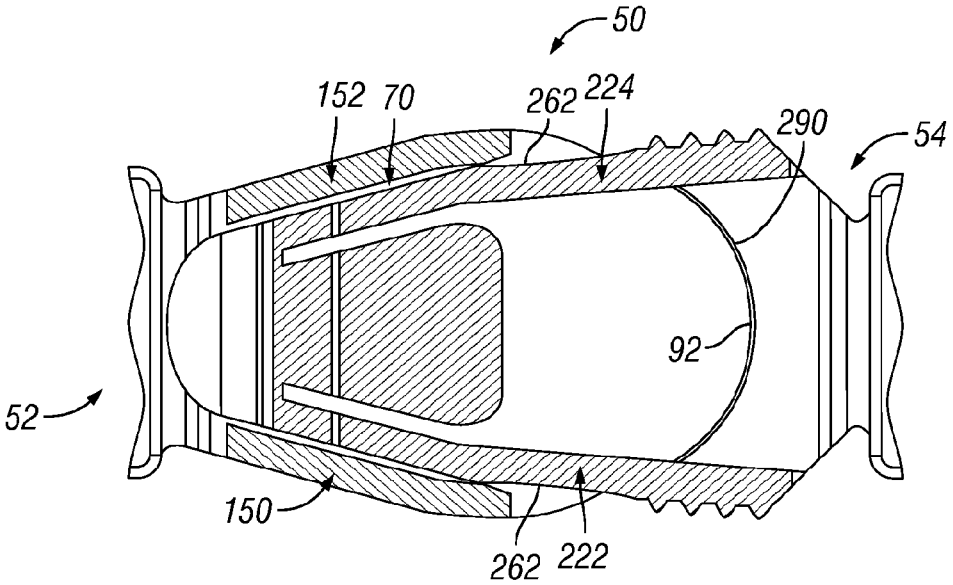

In exemplary embodiments, additional complimentary features of the receiver and latch members 52, 54 promote ease of complete insertion to the locked state. For example, FIG. 8A shows that with the lower face bearing region 284 of the latch member 54 abutting the receiving surface 84 of the receiver member 52, the leading end 210 of the latch member 54 is lifted away from the receiving surface 84 (due, for example, to the angled relationship of the guide and bearing regions 282, 284 of the lower face 272), thereby preventing inadvertent "catching" of the leading end 210 against the receiver member 52. Further, the leading end 210 is sized and shaped to readily extend through or beyond the engagement slot 132. Additionally, the cross-sectional view of FIG. 8C illustrates that in the locked state, the tapered width of the latch member 54 generally corresponds with the width of the guide slot 70, allowing the arms 222, 224 to readily slide along/relative to the corresponding receiver member walls 150, 152. In some embodiments, geometries of the receiver and latch members 52, 54 is such that in the locked state, the trailing region 262 of each of the arms 222, 224 can contact or bear against an inner surface of the corresponding wall 150, 152, further impeding over-insertion of the latch member 54. FIG. 8C further reflects that in an exemplary embodiment, a convex shape of the receiver member perimeter edge 92 substantially matches a concave shape of the latch member receiving edge 290, providing a substantially smooth or continuous surface between the receiver and latch members 52, 54. This optional relationship is further clarified by FIG. 8A in which due to the offset arrangement of the foot 226 relative to the arms 222, 224, the lower face 292 of the foot 226 is substantially aligned or contiguous with the contact surface 86 of the receiver member platform 60. When worn by a user, then, the smooth, continuous surface effectuated by a combination of the lower face 292 and the contact surface 86 can comfortably contact, and is unlikely to irritate, the user's skin.

Figure 9:
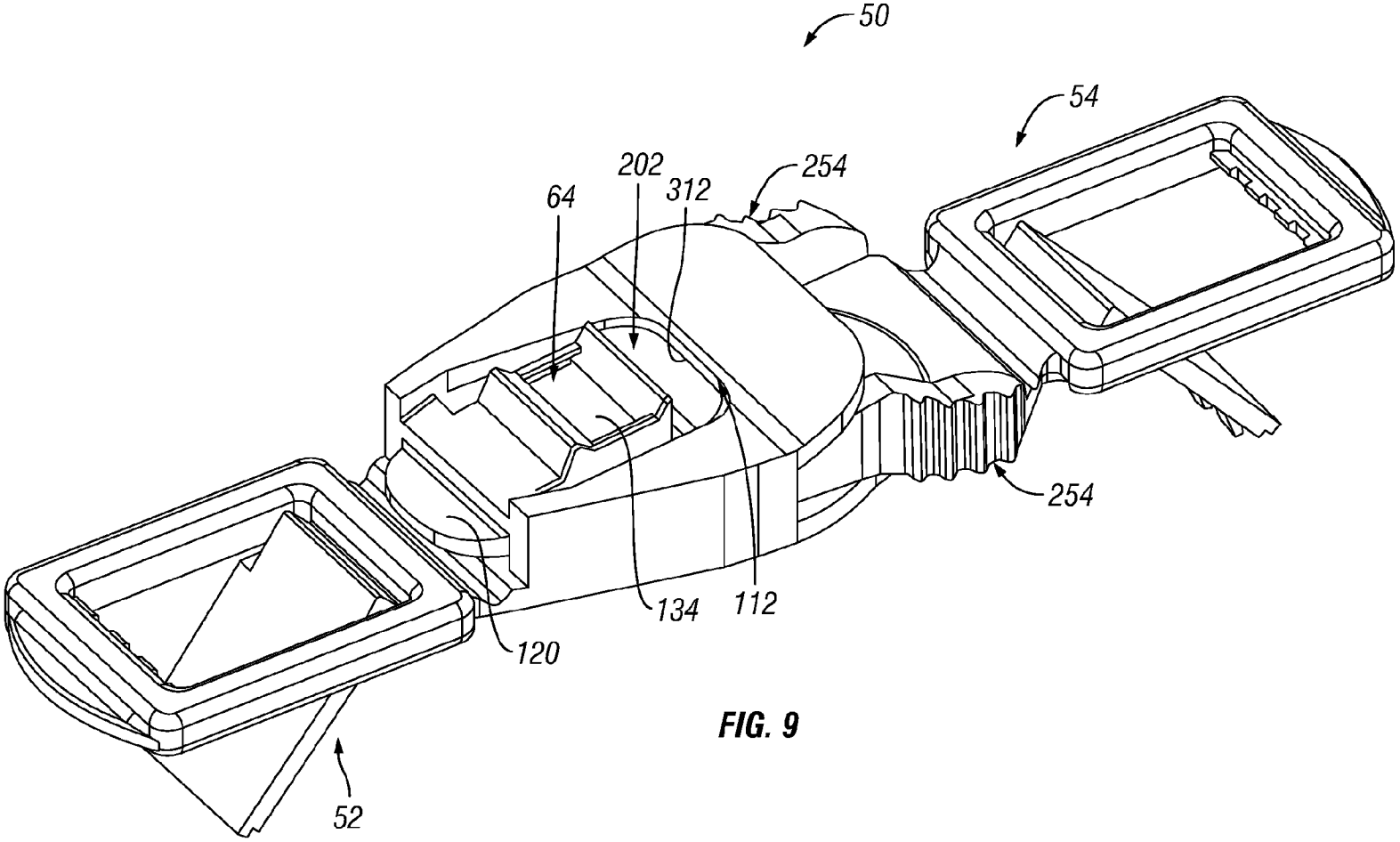
FIG. 9 is a perspective view of the buckle assembly of FIG. 2 in the latched state.

The perspective view of FIG. 9 provides a more complete illustration of the buckle device 50 in the locked state (for ease of illustration, the straps 22*a*, 22*b* (FIG. 2) are omitted from the view). When a user desires to detach the receiver and latch members 52, 54, the user once again grasps the latch member 54 with one hand. In this regard, and recalling that the buckle assembly 50 may oftentimes be located behind the user's head or neck, the optional serrated grip regions 254 (that are otherwise located well beyond the receiver member 52) provide a readily-identifiable surface for a user to inherently "know" where to grasp the latch member 54 without visual confirmation. The receiver member 52 is grasped by the user's other hand, and the release arm 64 is actuated to transition the buckle assembly 50 to a released state. More particularly, and with additional reference to FIG. 8A, a tactile feel provided by the actuator surface 134 of the release arm 64 naturally guides a user to place his or her finger (or thumb) on to the actuator surface 134 without visual confirmation. The user then applies an actuation (e.g., pressing) force on to the actuator surface 134, causing the release arm 64 to deflect toward the latch tab 202 (with the release arm 64 pivoting at the pivot end 120 in some embodiments). As the release arm 64 is brought into contact with the latch tab 202, continued application of the actuation force on to the release arm 64 is transferred to the latch tab 202, causing the latch tab 202 to deflect as described above. With further deflection of the latch tab 202, the latch face 312 is eventually maneuvered beyond the capture surface 112 such that the latching body 310 is now "clear" of the capture surface 112. In this released state, the latch face 312 no longer engages the capture surface 112, allowing the latch member 54 to be pulled away from the receiver member 52 (and/or vice-versa) and back to the detached state of FIG. 2. With exemplary embodiments of the present disclosure, then, a user is naturally encouraged to quickly and correctly perform a release operation without having to view the buckle assembly 50, and without having to manipulate or articulate any components of the latch member 54.

Figure 10:
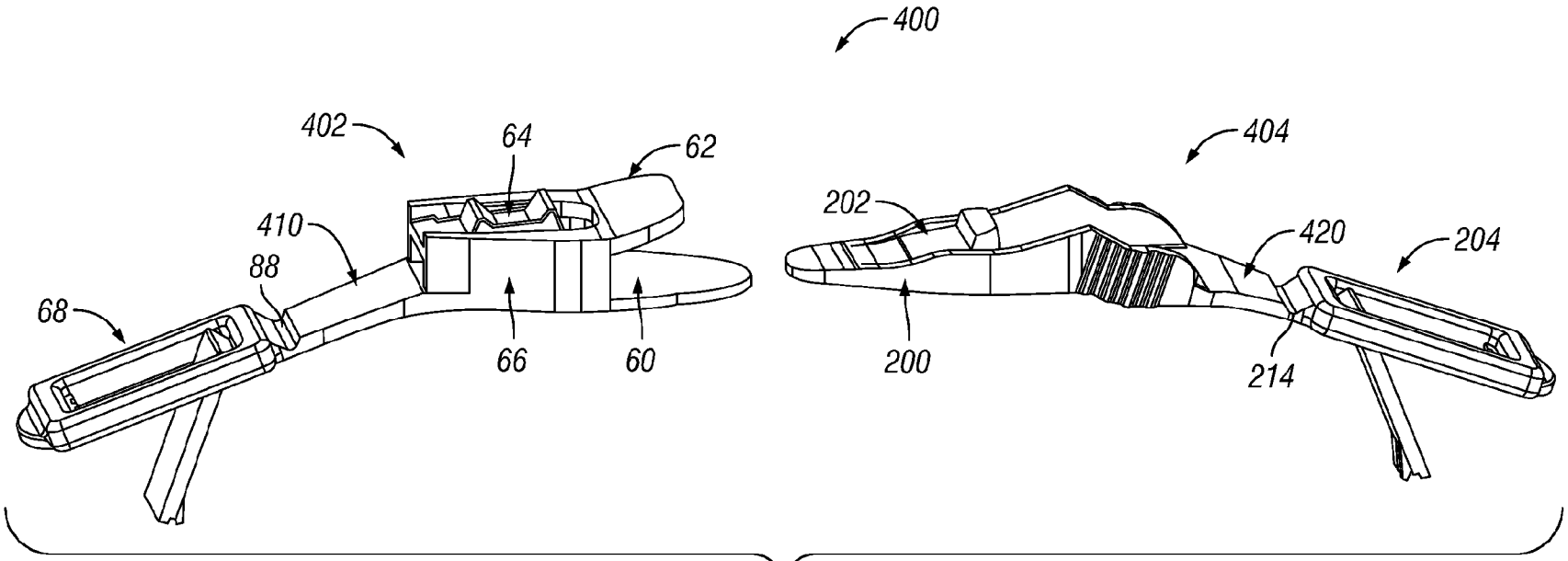
FIG. 10 is a perspective view of another buckle assembly in accordance with principles of the present disclosure and useful with the personal protective device of FIG. 1.

Another embodiment buckle assembly 400 in accordance with principles of the present disclosure is shown in FIG. 10. The buckle assembly 400 can be highly akin to the buckle assembly 50 (FIG. 2) described above, and includes a receiver member 402 and a latch member 404. In many respects, the receiver member 402 can be identical to the receiver member 52 (FIG. 2) and the latch member 404 can be identical to the latch member 54 (FIG. 2), incorporating any or all of the features described above as useful for simple, user-prompted connection from the detached state of FIG. 10 to the locked state of FIG. 11 (and vice-versa). In additional, the exemplary receiver and latch members 402, 404 optionally provide enhanced surface area (as compared to the receiver and latch members 52, 54, respectively) for interfacing with a user's skin (when the buckle assembly 400 is worn or disposed, for example, along a back of the user's neck).

Figure 11:
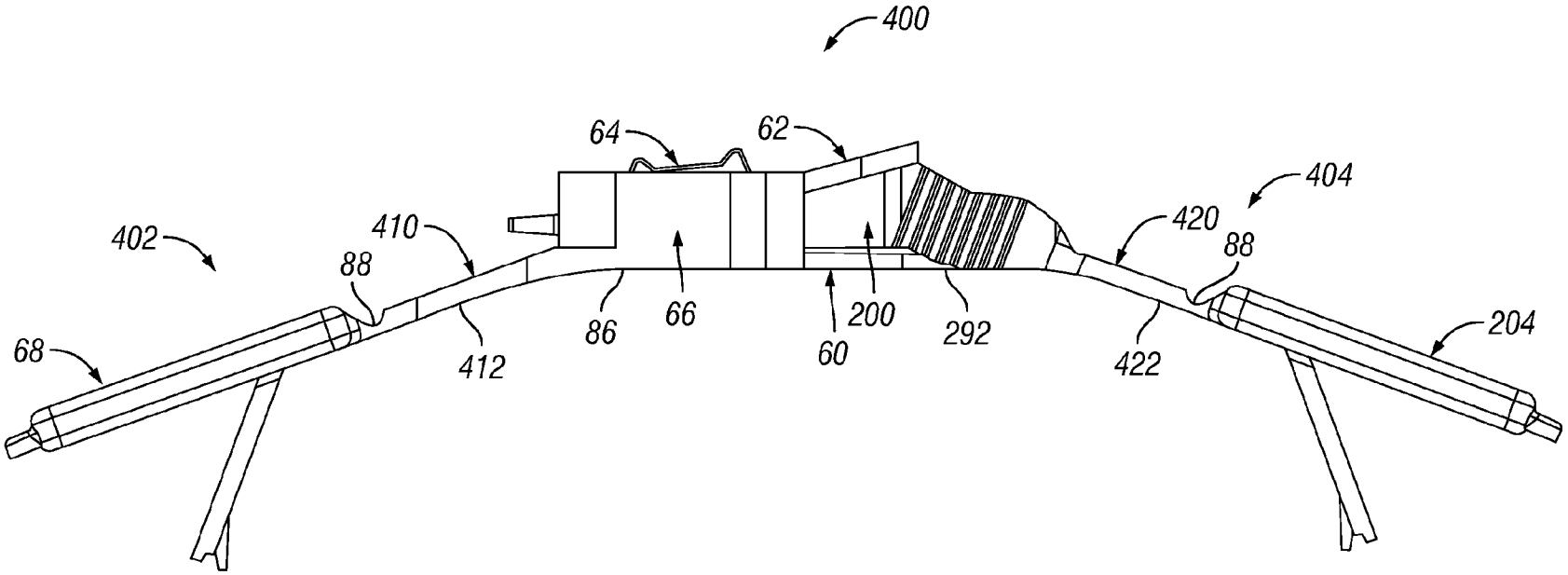
FIG. 11 is a side view of the buckle assembly of FIG. 10 in a latched state.

The receiver member 402 includes one or more of the platform 60, the head 62, the release arm 64, the frame 66 and the strap retaining device 68 as described above. In addition, the receiver member 402 forms or provides an extension body 410 between the platform 60 and the strap retaining device 68. For example, and as compared to the receiver member 52 (FIG. 2) described above, the extension body 410 provides an enhanced or enlarged surface area between the platform 60 and the living hinge 88. As best shown in FIG. 11, a bottom surface 412 of the extension body 410 is continuous with the contact surface 86 of the platform 60, but defines a curvature or bend relative to a plane of the contact surface 86.

The latch member 404 similarly differs from the latch member 54 (FIG. 2), and includes one or more of the base 200, the latch tab 202 and the strap retaining device 204 as described above. In addition, the latch member 404 forms or provides an extension body 420 between the base 200 and the strap retaining device 204. For example, and as compared to the latch body 54 described above, the extension body 420 provides an enhanced or enlarged surface area between the base 200 and the living hinge 214. As best shown in FIG. 11, a lower face 422 of the extension body 420 is continuous with the lower face 292 of the base 200, but defines a curvature or bend relative to a plane of the lower face 292.

With the above construction and in the locked state of FIG. 11, the extension bodies 410, 420 provide an enhanced area of contact with the user's skin as compared to the buckle assembly 50 (FIG. 2), with the straps (not shown, but akin to the straps 22*a*, 22*b* of FIG. 2) being shorter and thus contacting less of the user's skin when worn. By forming the receiver and latch members 402, 404 from a plastic material, the bottom surface 412 and the lower face 422 can be rendered highly smooth, and thus can be less irritating to a user's skin than the elastic (or other material) straps. Further, the curvature of the extension bodies 410, 420 relative to the corresponding platform 60 and base 200 more readily conforms to the natural shape of the user's neck, thus also possibly improving comfort when worn.

Figure 12:
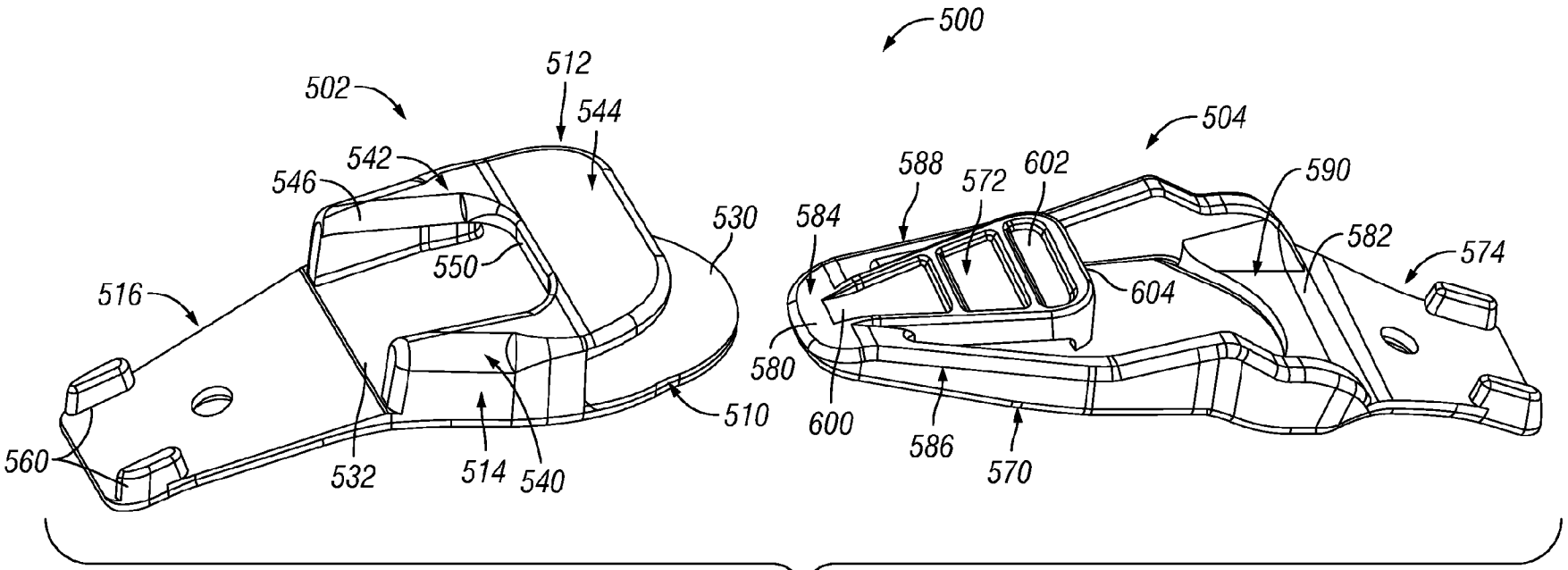
FIG. 12 is a perspective view of another buckle assembly in accordance with principles of the present disclosure and useful with the personal protective device of FIG. 1.

Another embodiment of a buckle assembly 500 of the present disclosure is shown in FIG. 12 (in a detached state). The buckle assembly 500 is configured for selective connecting straps provided with a personal protective device (such as the straps 22*a*, 22*b* of FIG. 2), and includes a receiver member 502 and a latch member 504. Details on the various components are provided below. In general terms, however, the receiver member 502 and the latch member 504 are each configured for coupling to a respective one of the straps. Further, the receiver and latch members 502, 504 incorporate complimentary features that facilitate transitioning of the buckle assembly 500 by a user from the detached state of FIG. 12 (in which the receiver and latch members 502, 504 are separated from one another) to a latched state in which the latch member 504 is locked or latched to the receiver member 502, thus connecting the corresponding straps. Further, the receiver and latch members 502, 504 incorporate complimentary features that facilitate transitioning of the buckle assembly 500 from the latched state to a released state in which the latch member 504 can be removed or withdrawn from the receiver member 502 (and/or vice-versa).

Figure 13:
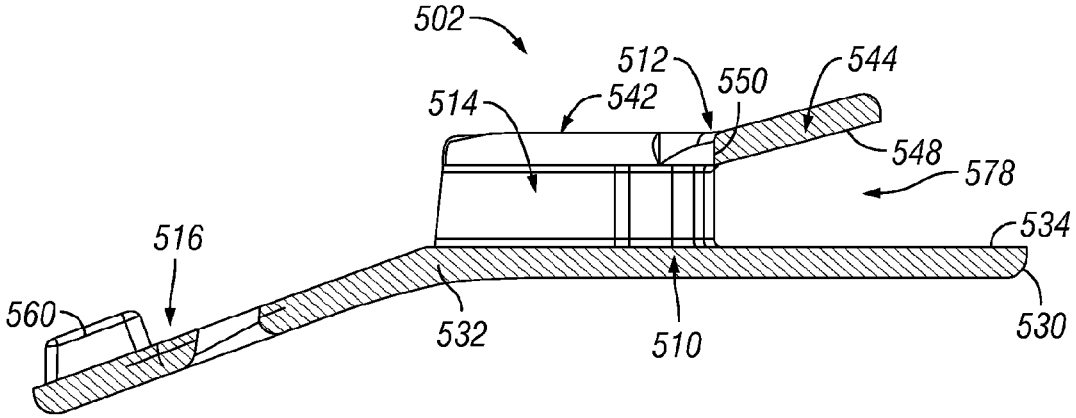
FIG. 13 is a longitudinal cross-sectional view of a receiver element of the buckle assembly of FIG. 12.

With additional reference to the cross-sectional view of FIG. 13, the receiver member 502 can be an integral, homogenous body that forms or defines a platform 510, a head 512, a frame 514, and a strap retaining device 516. The platform 510, the head 512, and optionally the frame 514 combine to define a slot 518 sized to receive the latch member 504.

The platform 510 defines opposing, first and second ends 530, 532, and a receiving surface 534 that in some embodiments can be substantially flat or planar (e.g., within 10% of a truly planar surface). The head 512 is spaced above the receiving surface 534 by the frame 514, and includes or defines opposing support segments 540, 542 and a guide segment 544. The support segments 540, 542 extend in a spaced apart fashion from the second end 532 to define a notch 546. The guide segment 544 extends between the support segments 540, 542, and defines a guide surface 548 and a capture surface 550. The guide surface 548 can be spatially arranged relative to a plane of the receiving surface 534 as shown, defining the slot 518 to have a tapering height in a direction of the second end 532. The capture surface 550 is arranged to face in a direction of the second end 532. As shown, the platform 510 can project beyond the guide segment 544 in extension to the first end 530.

The strap retaining device 516 can assume a variety forms appropriate for connection to a strap. With the non-limiting example of FIGS. 12 and 13, the strap retaining device 516 includes or provides posts 560 configured to maintain an attachment apparatus (not shown) otherwise useful for connection to a strap.

Figure 14:
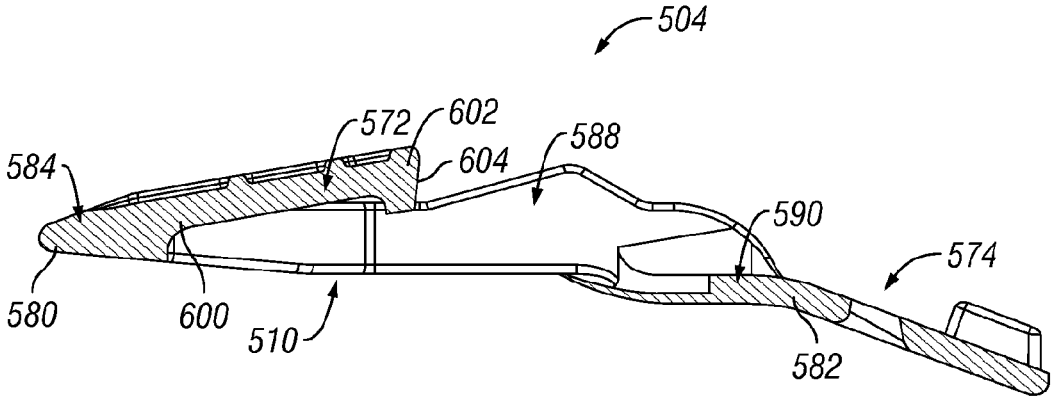
FIG. 14 is a longitudinal cross-sectional view of a latch element of the buckle assembly of FIG. 12.

With reference to FIG. 12 and the cross-sectional view of FIG. 14, the latch member 504 can be an integral, homogenous body that forms or defines a base 570, a latch tab 572 and a strap retaining device 574. The base 570 defines opposing, leading and trailing ends 580, 582, and includes or forms a shoulder 584, opposing arms 586, 588 and a foot 590. The arms 586, 588 extend between the shoulder 584 and the foot 590 to in a spaced apart fashion to define an aperture 592.

The latch tab 572 is connected to the shoulder 584 at a fixed end 600, and extends in a direction of the trailing end 582 to a free end 602. Extension of the latch tab 572 from the shoulder 584 can include an upward component (relative to the orientation of FIG. 14) such that the latch tab 572 optionally projects above the arms 586, 588. The latch member 504 is configured such that the latch tab 572 can be selectively deflected or articulated from the neutral condition of FIGS. 12 and 14, effectively pivoting at the fixed end 600. Finally, the latch tab 572 forms or defines a latch face 604 arranged to face the trailing end 582 (e.g., the latch face 604 is formed at the free end 602).

The strap retaining device 574 can assume any form appropriate for connection to a strap, including any of the configurations described above.

Figure 15A:
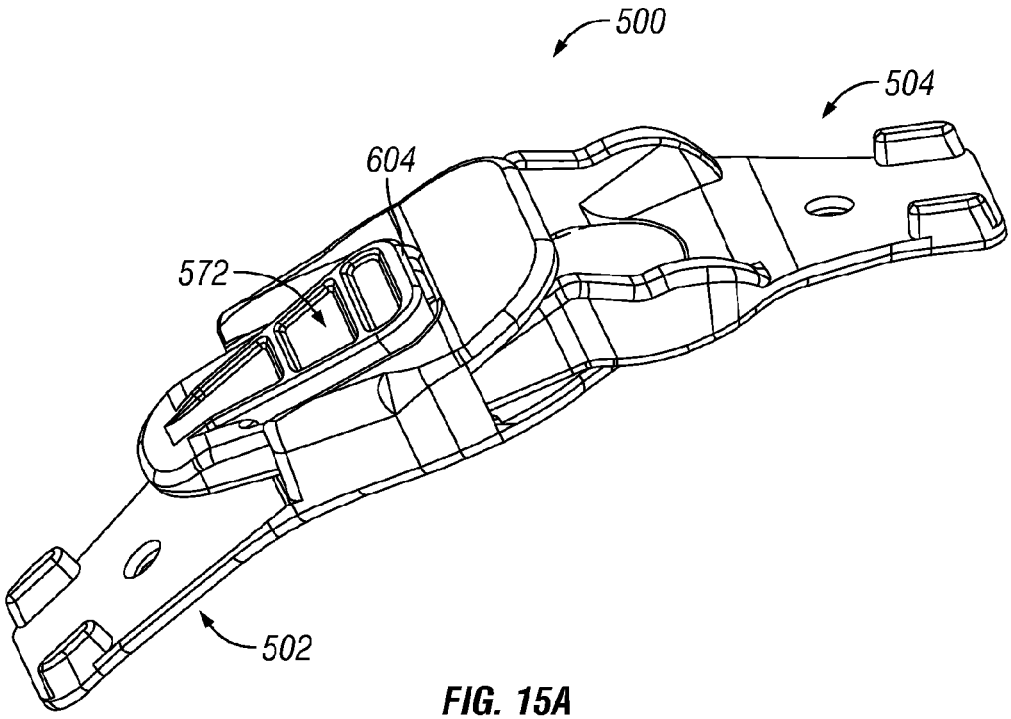
FIG. 15A is a perspective view of the buckle assembly of FIG. 12 in a latched state.
Figure 15B:
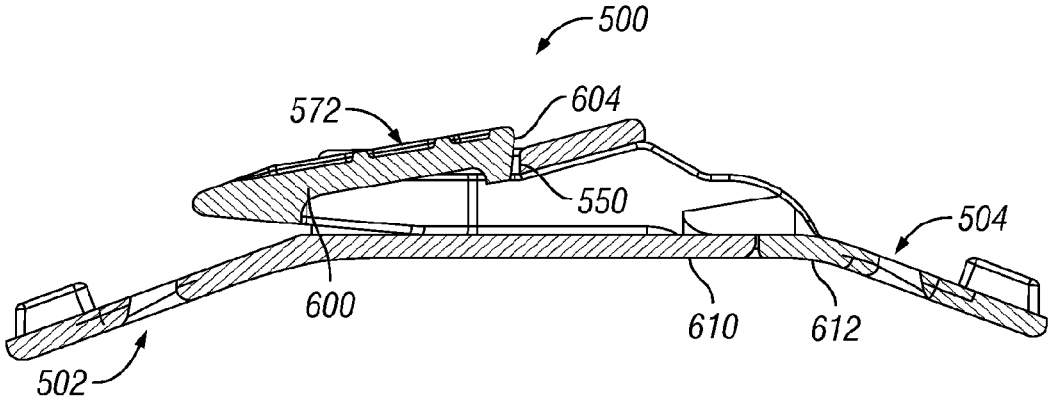
FIG. 15B is a longitudinal cross-sectional view of the buckle assembly of FIG. 15A.

With cross reference between FIGS. 12-14, various geometries of the receiver member 502 and the latch member 504 can be akin to those described above with respect to the receiver and latch members 52, 54 (FIG. 2) and otherwise conducive to simplified, guided insertion of the latch member 504 into the slot 518 of the receiver member 502. For example, the leading end 580 of the latch member 504 is easily inserted into the enlarged slot 518 at the guide segment 544, with the guide surface 548 and other surfaces of the receiver member 502 naturally guiding or directing the latch member 504 into alignment with the receiver member 502 as described above. At a stage of insertion whereby the latch tab 572 slidably contacts the guide surface 544 (and the base 570 is simultaneously in sliding contact with the receiving surface 534), the receiver member 502 exerts a compressive force on to the latch tab 572, causing the latch tab 572 to deflect with continued insertion. Forced deflection of the latch tab 572 continues until the latch face 604 is clear of the guide segment 544, and in particular has progressed beyond the capture surface 550. At this point, the latch tab 572 naturally self-reverts back to the neutral condition, transitioning the buckle assembly 500 to the locked state of FIGS. 15A and 15B. In the locked state, the latch face 604 engages or can engage the capture surface 550 in the event latch member 504 is inadvertently pulled relative to the receiver member 502 (and/or vice-versa). Lower surfaces 610, 612 of the receiver and latch members 502, 504, respectively, are optionally substantially contiguous at the point of connection, providing a relatively continuous, smooth surface for contacting the user's skin.

To detach the latch member 504 from the receiver member 502, the buckle assembly 500 is transition to a released state by a user-applied actuating (e.g., pressing) at the latch tab 572. The latch tab 572 deflects in response to this force, pivoting at the fixed end 600. Once the latch tab 572 has sufficiently deflected to manipulate the latch face 604 away from or clear of the capture surface 550 (i.e., the released state), the latch member 502 can be pulled or withdrawn from the receiver member 502.

The buckle assemblies of the present disclosure provide a marked improvement over previous designs. Corresponding geometries of the receiver and latch members are provided with large features that are easy to find when working blind (e.g., behind the head or neck), making the buckle assembly easy to connect. There optionally are significant lead-in angles in both the height and width (X and Y) dimensions to "help" the latch member find the receiver member easily, guide the latch member into place. In some embodiments, the receiver member includes a release arm with features that create good tactile feedback that make it easy to locate when working blind. Pressing the release arm pushes on the latch tab of the latch member, causing the latch tab to release. Further, the latch member optionally includes serrated grip features on each side to improve grip in a logical position when latch or unlatching the buckle assembly. The receiver and latch members are optionally designed so that the user's hands stay with each component throughout the latching/unlatching process. This makes the buckle assembly easier to use as compared to conventional designs as the user does not lose contact with the active parts at any time, rendering the buckle assembly easier to locate and use behind the head. As a point of reference, when parts of a latch mechanism slide over or past the user's finger(s) during operation, it creates some confusion as to whether the latching/unlatching process has been done correctly and/or loss of contact with the initial landing surfaces by the user's fingers interrupts the flow of movement.

The foregoing detailed description and examples have been given for clarity of understanding only. No unnecessary limitations are to be understood there from. It will be apparent to those skilled in the art that many changes can be made in the embodiments described without departing from the scope of the disclosure. Any feature or characteristic described with respect to any of the above embodiments can be incorporated individually or in combination with any other feature or characteristic, and are presented in the above order and combinations for clarity only. Thus, the scope of the present disclosure should not be limited to the exact details and structures described herein, but rather by the structures described by the language of the claims, and the equivalents of those structures.

What is claimed is:

1. A buckle assembly for selectively connecting first and second straps of a personal protective device, the buckle assembly comprising:

a receiver member configured for coupling to the first strap, the receiver member including:

a platform defining a receiving surface and opposing, first and second ends, a head disposed over the receiving surface and defining a capture surface facing the second end, wherein the head is spaced from the receiving surface to define at least a portion of a slot, a release arm pivotally connected to the head adjacent the second end, wherein the release arm extends above the receiving surface and terminates at an actuator surface apart from the capture surface; and a latch member configured for coupling to the second strap segment, the latch member including:

a base defining a leading end opposite a trailing end, wherein the base defines an aperture, a latch tab pivotally connected to the base adjacent the leading end, the latch tab extending within the aperture and terminating at a latch face;

wherein the buckle assembly is configured to provide latched state in which the latch member is disposed within the slot and the latch face is engaged with the capture surface, the latched state including the release arm disposed over a portion of the latch tab;

and further wherein the buckle assembly is configured to transition from the latched state to a released state in which the latch face is disengaged from the capture surface in response to an actuation force applied to the actuator surface, wherein an engagement slot is defined between the release arm and the receiving surface, and further wherein the latched state includes a portion of the latch tab disposed within the engagement slot, wherein the engagement slot tapers in height in a direction of the second end.

2. The buckle assembly of claim 1, wherein the latch member is configured such that the release arm pivots in response to the actuation force, including the actuator surface moving relative to the head.

3. The buckle assembly of claim 2, wherein the buckle assembly is configured such that in the latched state, the actuation force applied to the actuator surface is transferred to the latch tab.

4. The buckle assembly of claim 2, wherein the buckle assembly is configured such that in the latched state, the latch face moves with movement of the actuator surface.

5. The buckle assembly of claim 1, wherein the latch member further includes serrated grip regions at opposite sides of the base.

6. The buckle assembly of claim 5, wherein the serrated grip regions are located away from the receiver member in the latched state.

7. The buckle assembly of claim 1, wherein the head includes a guide segment extending from the capture surface in a direction of the first end to a tip end opposite the capture surface, and further wherein the guide segment defines a major plane that is non-parallel with a major plane of the receiving surface.

8. The buckle assembly of claim 1, wherein the receiver member further includes opposing side walls disposed between the platform and the head, and further wherein a lateral spacing between the opposing side walls tapers in a direction of the second end.

9. The buckle assembly of claim 1, wherein the head includes opposing support segments extending from the second end in a direction of the first end, the support segments defining a notch, and further wherein the release arm projects within the notch.

10. The buckle assembly of claim 1, wherein the buckle assembly is configured such that in the latched state, the leading end of the base projects beyond the second end of the platform in a direction opposite the first end.

11. The buckle assembly of claim 1, wherein the base defines an aperture configured to receive the platform in the latched state.

12. The buckle assembly of claim 1, wherein the receiver member further includes a strap retaining device configured to selectively retain the first strap and connected to the platform adjacent the second end, and further wherein the latch member further includes a strap retaining device configured to selectively retain the second strap and connected to the base adjacent the trailing end.

13. A personal protective device, comprising:

a mask body adapted to be worn on a face of user;

a first strap extending from a first side of the mask body;

a second strap extending from a second side of the mask body; and a buckle assembly comprising:

a receiver member coupled to the first strap, the receiver member including:

a platform defining a receiving surface and opposing, first and second ends, a head disposed over the receiving surface and defining a capture surface facing the second end, wherein the head is spaced from the receiving surface to define at least a portion of a slot, a release arm pivotally connected to the head adjacent the second end, wherein the release arm extends above the receiving surface and terminates at an actuator surface apart from the capture surface, a latch member configured for coupling to the second strap segment, the latch member including:

a base defining a leading end opposite a trailing end, wherein the base defines an aperture, a latch tab pivotally connected to the base adjacent the leading end, the latch tab extending within the aperture and terminating at a latch face;

wherein the buckle assembly is configured to provide latched state in which the latch member is disposed within the slot and the latch face is engaged with the capture surface, the latched state including the release arm disposed over a portion of the latch tab;

and further wherein the buckle assembly is configured to transition from the latched state to a released state in which the latch face is disengaged from the capture surface in response to an actuation force applied to the actuator surface, wherein an engagement slot is defined between the release arm and the receiving surface, and further wherein the latched state includes a portion of the latch tab disposed within the engagement slot, wherein the engagement slot tapers in height in a direction of the second end.

14. The personal protective device of claim 13, wherein the personal protective device is a respiratory protection device.

15. The personal protective device of claim 14, wherein the mask body is adapted for placement over a mouth and nose of a user.

16. The personal protective device of claim 13, wherein the latch member is configured such that the release arm pivots in response to the actuation force, including the actuator surface moving relative to the head.

17. The personal protective device of claim 16, wherein the buckle assembly is configured such that in the latched state, the actuation force applied to the actuator surface is transferred to the latch tab.

18. The personal protective device of claim 13, wherein the first and second straps are positionable about a neck of a user when the buckle assembly is in the latched state.

* * * * *